US009409055B1

(12) United States Patent
Niemela

(10) Patent No.: US 9,409,055 B1
(45) Date of Patent: Aug. 9, 2016

(54) TREE CLIMBING SUPPORT

(76) Inventor: Cal G. Niemela, Chassell, MI (US)

( * ) Notice: Subject to any disclaimer, the term of this patent is extended or adjusted under 35 U.S.C. 154(b) by 1128 days.

(21) Appl. No.: 13/275,408

(22) Filed: Oct. 18, 2011

Related U.S. Application Data

(60) Provisional application No. 61/394,425, filed on Oct. 19, 2010, provisional application No. 61/510,196, filed on Jul. 21, 2011.

(51) Int. Cl.
*A63B 27/00* (2006.01)

(52) U.S. Cl.
CPC ..... *A63B 27/00* (2013.01)

(58) Field of Classification Search
CPC ..... A63B 27/00
USPC ..... 182/90, 92, 151, 153
See application file for complete search history.

(56) References Cited

U.S. PATENT DOCUMENTS

| | | | | | |
|---|---|---|---|---|---|
| 159,126 | A | | 1/1875 | Van Zandt | 182/24 |
| 907,483 | A | | 12/1908 | Ette | |
| 1,270,158 | A | | 6/1918 | Hill | |
| 1,719,997 | A | | 7/1929 | Pirsch | 182/156 |
| 1,748,673 | A | | 2/1930 | Hurst | |
| 1,953,298 | A | | 4/1934 | Goodwin | 182/91 |
| 2,052,439 | A | | 8/1936 | Bailey | 182/189 |
| 2,148,099 | A | | 2/1939 | Bray | 182/156 |
| 2,471,610 | A | * | 5/1949 | Christensen | A63B 59/50 403/165 |
| 2,680,593 | A | | 6/1954 | McIntyre | 182/231 |
| 3,019,851 | A | | 2/1962 | Doss | 182/111 |
| 3,148,857 | A | | 9/1964 | Hutchison | 248/247 |
| 3,233,591 | A | | 2/1966 | Rogers et al. | 119/796 |
| 3,493,079 | A | | 2/1970 | Dudschus | 182/141 |
| 3,596,736 | A | | 8/1971 | Crawford | 182/148 |
| 3,771,621 | A | * | 11/1973 | Goettl | H04R 1/025 181/151 |
| 3,891,273 | A | | 6/1975 | Takada | 297/476 |
| 4,061,306 | A | | 12/1977 | Taylor | 248/523 |
| 4,132,288 | A | | 1/1979 | Bingham | 182/156 |
| 4,413,706 | A | | 11/1983 | Michael | 182/91 |
| 4,415,061 | A | | 11/1983 | Meyer | |
| 4,432,436 | A | | 2/1984 | Suiter | 182/97 |
| 4,449,612 | A | * | 5/1984 | Southard | 182/92 |
| 4,542,805 | A | | 9/1985 | Hamlin et al. | 182/91 |

(Continued)

OTHER PUBLICATIONS

Exhibit A includes photos of various "climbing sticks," at least three of which ("Ameristep", "Muddy Outdoors," and "Gorilla") are believed to have been on sale more than one year prior to the filing date of this application.

*Primary Examiner* — Charles A Fox
*Assistant Examiner* — Kristine Florio
(74) *Attorney, Agent, or Firm* — Gardner, Linn, Burkhart & Flory, LLP

(57) ABSTRACT

A climbing support is provided for aiding a climber in scaling a tree, a wooden pole, or like surface. In one embodiment, the climbing support is configured for one-handed use, so that the support can be initially driven into a tree and then tightened against the tree with one hand. The climbing support includes a step body that supports a threaded fastener and an anti-rotation projection or spike, which together can be used to initially support the step as the climber drives the fastener to secure the step along the tree. Optionally, the climbing support includes an elongate body with a plurality of step members and at least one fastener disposed along the body. The climbing support may further include a pivotable spike for engaging the tree or pole, the spike being lockable in an angled position to enable it to support a portion of a user's weight.

17 Claims, 20 Drawing Sheets

(56) References Cited

U.S. PATENT DOCUMENTS

| | | | | |
|---|---|---|---|---|
| 4,669,575 | A | 6/1987 | Skyba | 182/92 |
| 4,696,372 | A * | 9/1987 | Fields | 182/92 |
| 4,697,669 | A * | 10/1987 | Bergsten | 182/92 |
| 4,719,990 | A | 1/1988 | Markovic | 182/163 |
| 4,867,272 | A | 9/1989 | Troubridge | |
| 4,877,110 | A | 10/1989 | Wolner | 182/232 |
| 5,040,635 | A | 8/1991 | Strickland | 182/100 |
| 5,242,030 | A | 9/1993 | Lobozzo | 182/187 |
| 5,253,732 | A | 10/1993 | Daniels | 182/116 |
| 5,267,632 | A | 12/1993 | Mintz | 182/116 |
| 5,279,388 | A | 1/1994 | Laughlin et al. | |
| 5,624,007 | A * | 4/1997 | Mahaffy | 182/92 |
| 5,655,623 | A | 8/1997 | Skyba | 182/116 |
| 5,743,353 | A | 4/1998 | Browning et al. | |
| 5,779,001 | A | 7/1998 | Skyba | 182/107 |
| 5,806,625 | A * | 9/1998 | Katz | 182/92 |
| 5,881,837 | A * | 3/1999 | Leicht | 182/92 |
| 5,899,124 | A * | 5/1999 | Cross, Jr. | 81/176.15 |
| 5,944,139 | A * | 8/1999 | Kozial | 182/92 |
| 6,170,609 | B1 | 1/2001 | Dech | 182/187 |
| 6,311,918 | B1 | 11/2001 | Specht | 242/382 |
| 6,334,508 | B1 | 1/2002 | Shields | 182/116 |
| 6,340,071 | B1 | 1/2002 | Diekemper | 182/100 |
| 6,439,343 | B1 | 8/2002 | Jorges et al. | |
| 6,484,981 | B1 | 11/2002 | Perrault | 248/218.4 |
| 6,547,035 | B1 | 4/2003 | D'Acquisto | 182/100 |
| 6,595,325 | B2 | 7/2003 | Ulrich | 182/136 |
| 6,668,975 | B2 | 12/2003 | Skipper | 182/100 |
| 6,782,840 | B1 | 8/2004 | Garelick et al. | 114/362 |
| 7,017,449 | B1 * | 3/2006 | Ritchings | 81/52 |
| 7,246,683 | B2 | 7/2007 | Pringnitz | 182/187 |
| 7,258,045 | B2 | 8/2007 | Smith | |
| 7,410,137 | B2 * | 8/2008 | Diggle et al. | 248/246 |
| 7,584,940 | B2 | 9/2009 | Gee | 254/238 |
| D631,980 | S * | 2/2011 | Henry | D25/69 |
| D631,981 | S * | 2/2011 | Henry | D25/69 |
| 7,882,931 | B2 | 2/2011 | D'Acquisto | 182/187 |
| 8,230,765 | B1 * | 7/2012 | Cooley | 81/176.15 |
| 8,371,558 | B2 * | 2/2013 | Engleman et al. | 254/390 |
| 8,556,035 | B1 | 10/2013 | Kendall et al. | 182/156 |
| 8,684,390 | B1 | 4/2014 | Barrette | 280/480.1 |
| 8,695,762 | B1 | 4/2014 | Carter et al. | 182/187 |
| 8,863,900 | B1 * | 10/2014 | Bolinger | 182/90 |
| 2004/0031898 | A1 | 2/2004 | Mijatovic | 248/330.1 |
| 2004/0035637 | A1 | 2/2004 | Skipper | 182/92 |
| 2004/0064932 | A1 * | 4/2004 | Sprague | 29/525.01 |
| 2005/0029045 | A1 * | 2/2005 | Cowin | 182/92 |
| 2005/0217937 | A1 | 10/2005 | Rohlf | 182/232 |
| 2007/0256892 | A1 | 11/2007 | Breedlove | 182/116 |
| 2008/0156588 | A1 | 7/2008 | Butcher | 182/200 |
| 2008/0196972 | A1 | 8/2008 | Bell | 182/92 |
| 2008/0283335 | A1 * | 11/2008 | Salerno | 182/133 |
| 2009/0045012 | A1 | 2/2009 | Menel | |
| 2009/0133960 | A1 * | 5/2009 | Yowonske | 182/189 |
| 2009/0178887 | A1 | 7/2009 | Reeves et al. | 182/239 |
| 2010/0050823 | A1 * | 3/2010 | Blankenship | 81/125 |
| 2013/0161127 | A1 | 6/2013 | Allred et al. | 182/108 |
| 2013/0299275 | A1 | 11/2013 | Westermann et al. | 182/3 |
| 2014/0027204 | A1 | 1/2014 | Niemela | 182/129 |

* cited by examiner

TREE CLIMBING SUPPORT

CROSS REFERENCE TO RELATED APPLICATION

The present application claims the priority benefit of U.S. provisional application Ser. No. 61/394,425, filed Oct. 19, 2010, and of U.S. provisional application Ser. No. 61/510,196, filed Jul. 21, 2011, which are hereby incorporated herein by reference in their entireties.

FIELD OF THE INVENTION

The present invention is directed to climbing apparatuses, and more particularly, to hand-holds or foot supports for scaling trees, poles, and the like.

BACKGROUND OF THE INVENTION

The ability to safely and efficiently climb or scale trees, wooden poles such as telephone or powerline poles, and similar structures or surfaces is useful for reaching elevated hunting blinds, servicing utility wires, and the like. Although ropes and ladders are sometimes used for climbing, it is also known to install transportable steps that can be driven into a tree or pole to provide hand holds or foot supports to aid in climbing. Typical screw-in steps, for example, are forced against a tree or pole while turning the entire step, which can be particularly difficult or dangerous to accomplish because it typically requires the use of two hands. This may be especially difficult or dangerous when the user has already climbed part way up the tree or pole. Other known devices include tree-climbing "sticks" that are typically strapped to a tree, and that include a plurality of steps for use in scaling the tree.

SUMMARY OF THE INVENTION

The present invention provides a climbing support or apparatus, such as a tree climbing step or an apparatus including a plurality of steps, that can be readily installed by one person and/or by using only one hand. This may be accomplished without applying an axial force to a fastener simultaneously with a rotating force. The climbing support can typically be installed in two steps: (i) driving the support against a tree or pole so that the support is temporarily supported at the outer surface of the tree or pole, and then (ii) turning a threaded fastener to secure the support to the tree or pole. The climbing supports may be configured for use with a storage rack that permits a user to store a plurality of climbing supports on their person, and remove individual climbing supports from the storage rack for installation as the user progressively scales the tree or pole. Optionally, a climbing support apparatus having two or more steps may be attached to a tree or pole using one or more fasteners and, optionally, a spike configured to be thrust into the tree. One or more standoffs can be used to space the steps away from the tree or pole so that the apparatus is easier to use.

According to one form of the present invention, a climbing support for use in climbing a tree or pole includes a body, a fastener movably disposed at the body, and a projection supported at the body and spaced from the fastener. The body has an upper support surface and a tree-facing surface, the tree-facing surface defining a bore for movably receiving the fastener. The fastener includes a tip portion spaced from a head portion, the head portion configured to facilitate rotation of the fastener. The fastener is supported at the body in a manner such that at least part of the tip portion projects from the tree-facing surface of the body when a force is applied to the tip portion in the direction of the tree-facing surface, so that during normal use, the fastener's tip portion cannot be fully retracted into the bore. The body can be engaged by a user's hand or by a tool, and the tip portion of the fastener and the projection can be manually driven against the outer portion of a tree or pole with the hand or tool. The tip portion of the fastener and the projection cooperate to initially support the body at the tree or pole, and the projection limits rotation of the body relative to the tree or pole as the user rotates the fastener to drive the tip portion further into the tree or pole to secure the body at the tree or pole.

In one aspect, the fastener includes a projection that selectively engages the body to limit longitudinal movement of the fastener in the bore when the fastener is moved a predetermined distance, whereby at least part of the tip portion of the fastener is prevented from retracting fully into the bore. Optionally, the tip portion of the fastener is at least partially threaded.

In another aspect, the body defines an opening below the upper support surface, the opening configured as at least one of (i) a hand-hold, (ii) a foot support, and (iii) a tool support. Optionally, and when the opening is configured as a tool support, the climbing support may be combined with a tool having a handle portion and a fastener-engaging portion. The opening of the body is configured to releasably couple to the fastener-engaging portion of the tool so that the tool can be grasped at the handle portion and used to drive the climbing support against the tree or pole. The fastener-engaging portion of the tool is configured to receive the head portion of the fastener to rotatably drive the fastener.

In yet another aspect, a biasing element is disposed along the fastener and configured to engage a portion of the body. The biasing element urges the body against the tree or pole when the tip portion of the fastener is driven at least partially into the outer portion of the tree or pole, which maintains the projection in engagement with the tree or pole as the fastener is rotated, thereby limiting or preventing rotation of the body with the fastener.

Optionally, the body includes an outwardly-facing surface that is spaced from the tree-facing surface, and which faces in generally the opposite direction of the tree-facing surface. The bore in the upper end portion of the tree-facing surface of the body also extends through the outwardly-facing surface, and the head portion of the fastener is at least initially spaced outwardly from the outwardly-facing surface. A biasing element is disposed along the fastener and held in compression between the head portion of the fastener and the outwardly-facing surface of the body. The biasing element urges the body and spike in the direction of the tree or pole when the tip portion of the fastener is initially driven at least partially into the outer portion of the tree or pole.

In another aspect, the biasing element is a coil spring with an inboard end disposed against the outwardly-facing surface, and an outboard end disposed against the head portion of the fastener.

In a further aspect, the head portion of the fastener includes a non-circular portion for engagement by a tool, such as a ratchet wrench, an open or closed end wrench, a screwdriver, a hex key wrench, pliers, or the like.

In a still further aspect, the climbing support is configured for use in combination with a support rack, where the opening of the body receives a portion of the support rack. A plurality of the climbing supports can be stored at the support rack to facilitate installation of the climbing supports.

In yet another aspect, the tree-facing surface of the body includes an upper portion for supporting the fastener, and a lower portion for supporting the projection. The upper portion includes an upper end that projects forwardly of the rest of the upper portion, and that also projects forwardly of the lower portion. For example, the upper portion may be sloped so that the upper end projects forwardly. The upper end acts as a fulcrum when the fastener is tightened into a tree or pole, to draw the projection into the tree or pole substantially simultaneously with the tightening of the fastener.

In another aspect, the projection is a standoff member that engages the tree or pole and maintains a space between the body and the tree or pole when the fastener is tightened. Optionally, the standoff member includes a generally C-shaped portion that is rotatably coupled to the body and repositionable between a substantially horizontal orientation for engaging the tree or pole, and a substantially vertical orientation for transport. Optionally, the body defines one or more apertures for receiving a portion of the standoff member when in the substantially vertical orientation. A biasing element may be provided to bias the standoff toward the body.

In still another aspect, the body is an elongate member defining the tree-facing surface and at least one step portion that extends outwardly from the elongate member and defines the upper support surface. Optionally, a plurality of step portions are provided in vertically spaced arrangement and on alternating sides of the elongate member. Optionally, the step portions are pivotable to a transport position or configuration, in which the step portions are substantially aligned along the elongate member.

In a further aspect, a biasing element is provided at the body for axially driving the fastener into the tree or pole. The biasing element may be an elastic cord with opposite ends that are attached to the body, and a middle portion that engages the fastener at the head portion. The elastic cord is arranged so that drawing the fastener away from the tree or pole stretches the elastic cord, and releasing the fastener causes the elastic cord to drive the fastener axially into the tree or pole.

According to another form of the present invention, a climbing support apparatus includes an elongate body, a step member extending outwardly from the elongate body, a fastener, and a standoff member. The fastener is movably coupled to the elongate body and has a tip portion and a head portion. The tip portion is drivable into a tree or pole and is securable at the tree or pole in order attach the climbing support apparatus thereto. The standoff member is coupled to the elongate body and is configured to engage the tree or pole and to maintain a space between the elongate body and the tree or pole when the fastener is secured.

In one aspect, the climbing support includes a crank arm operatively coupled to the head portion of the fastener for rotatably driving the fastener into the tree or pole. Optionally, the crank arm includes a gripping portion and is pivotable relative to the fastener between a use position and a stowed position. The elongate body may optionally define an opening for receiving the gripping portion of the crank arm when the crank arm is pivoted to the stowed position.

In another aspect, the climbing support further includes a pivotably mounted spike at a lower end portion of the elongate body. The spike is positionable in a straight configuration in which the spike is oriented substantially longitudinally with the elongate body to extend substantially straight out from the lower end portion thereof, so that the apparatus with spike can be thrust in a spear-like manner. The spike is also positionable at an angled configuration in which the spike projects toward the tree or pole when the elongate body is substantially parallel to the tree or pole.

In a further aspect, the climbing support includes a deployment mechanism for selectively locking or engaging the spike in its angled position. The deployment mechanism includes a movable lock element and a coupler element for linking the lock element to one of the steps. The lock element is configured to selectively engage and disengage the spike when the spike is in the angled configuration, so that the lock element limits pivoting movement of the spike in at least one direction when the lock element engages the spike. The coupler element is coupled to one of the step members, and the coupler element translates in response to moving the step member between the transport configuration and a use configuration, to thereby engage and disengage the spike with the lock element.

Thus, the climbing support of the present invention provides a step or hand hold that facilitates one-handed or at least one-person installation and/or provides a compact climbing support assembly or apparatus that is readily secured to a tree or pole. The climbing support may be initially set into or against the tree or pole by first thrusting or driving the climbing support against the tree or pole to engage a threaded fastener tip and/or a projection or spike, to temporarily hold the climbing support in place. Once the climbing support is initially set, the fastener can be rotated, such as with a wrench or crank arm or other tool, in order to secure the climbing support at the tree or pole. The spike or projection maintains proper alignment of the climbing support as torque is applied to the fastener, and may provide additional stabilization and support for the climbing support and a user positioned thereon.

These and other objects, advantages, purposes, and features of the invention will become more apparent upon review of the following specification in conjunction with the drawings.

DESCRIPTION OF THE PREFERRED EMBODIMENTS

Figure 1:
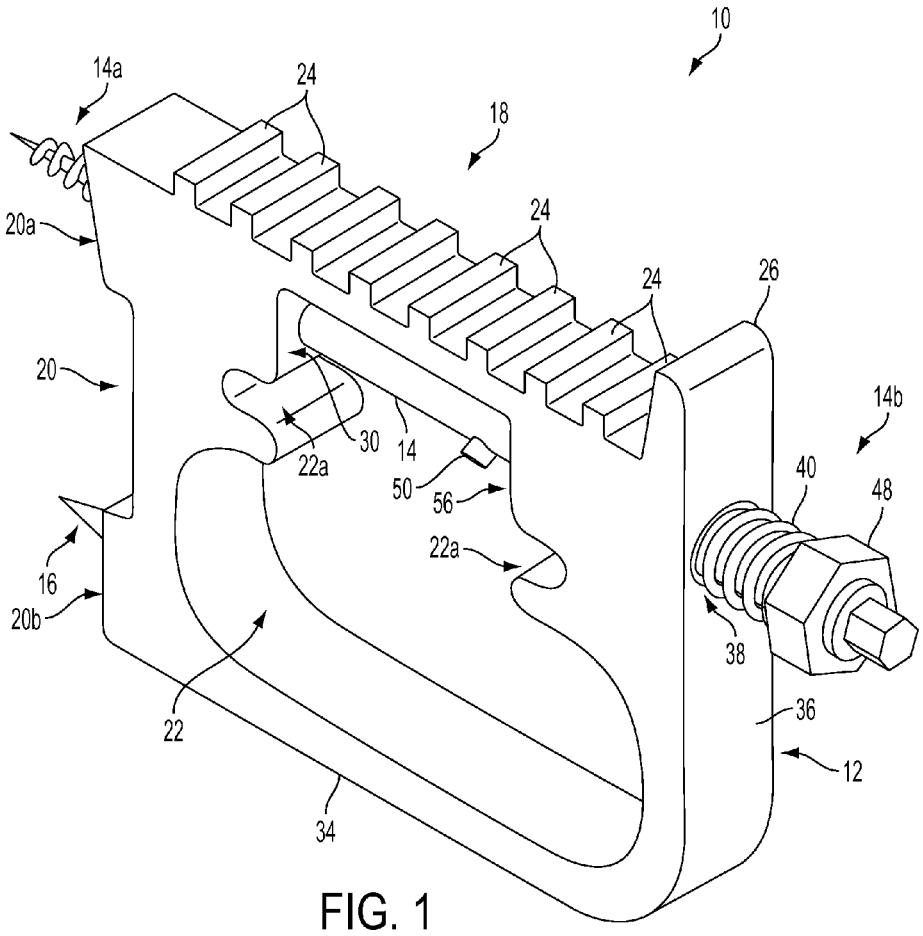
FIG. 1 is a perspective view of a climbing support in accordance with the present invention.

Referring now to the drawings and the illustrative embodiments depicted therein, a climbing support or tree climbing step 10 includes a step body 12, a rotatable fastener 14, and a projection in the form of a spike 16. Step body 12 includes an upper support surface 18 for use as a foot support or hand-hold by a climber, and a tree-facing surface 20. Step body 12 defines an opening 22 that can be used as a hand-hold during installation of the climbing step. Tree climbing step 10 may be grasped by a climber placing their fingers through opening 22, so that the climbing step can be manually driven or thrust against a tree, a pole, or the like. This permits the climbing step to be initially set against the tree or pole and temporarily retained by initial engagement of fastener 14 and spike 16. The fastener 14 can then be turned to bore further into the tree or pole, while spike 16 limits or prevents rotation of step body 12, to thereby secure the climbing step 10 for use in supporting the weight of a climber. To simplify the remaining description, the term "tree" will be used hereafter to refer to any readily-penetrable surface, including wooden or wood-like poles, or planar or polygonal surfaces or the like.

Upper support surface 18 of step body 12 includes a plurality of projections or traction lugs 24, and an upstanding end portion 26 that extends above the height of traction lugs 24 to help prevent a climber's hand or foot from slipping off the end of the upper support surface 18. In the illustrated embodiment, traction lugs 24 are elongated rectangular bars that engage a climber's footwear or hand to reduce the risk of slipping. It will be appreciated that substantially any shape of traction lug may be used, or none at all, without departing from the spirit and scope of the present invention.

Tree-facing surface 20 of step body 12 includes an upper end portion 20*a* near upper support surface 18, and a lower end portion 20*b* spaced below upper end portion 20*a*. In the illustrated embodiment, upper end portion 20*a* is sloped so that its upper end, where it meets with upper support surface 18, is positioned forwardly of the rest of upper end portion 20*a*, and so that its upper end is positioned forwardly of lower end portion 20*b*. In this arrangement, the upper end of upper end portion 20*a* acts as a fulcrum, as will be described below.

Figure 2:
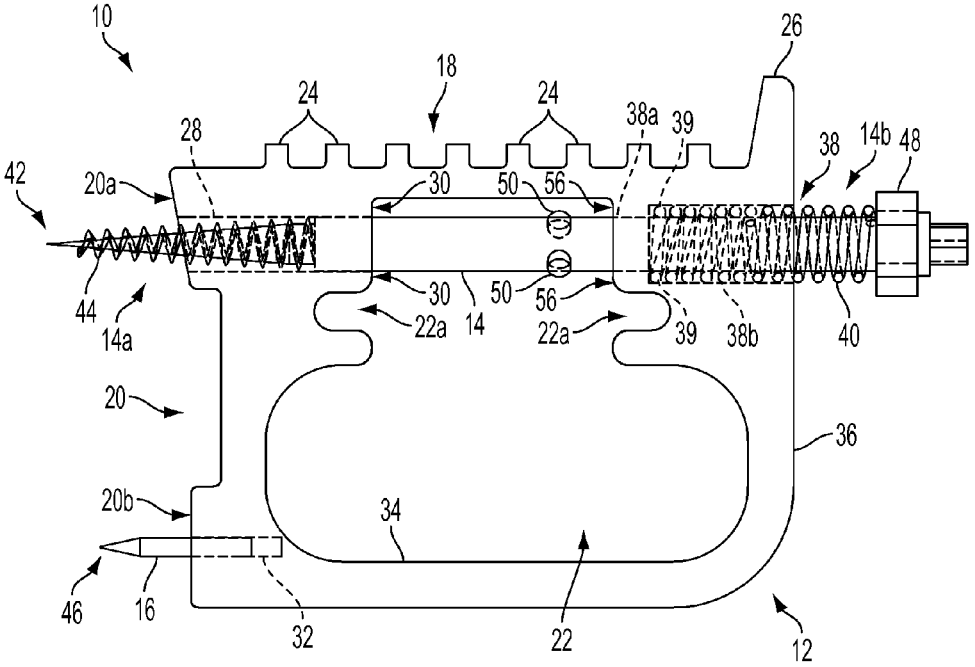
FIG. 2 is a side elevation of the climbing support of FIG. 1.

Step body 12 defines a bore 28 (FIG. 2) that extends through upper end portion 20*a*, and receives at least part of a tip portion 14*a* of fastener 14. An outwardly-facing surface 30 of step body 12 defines a part of opening 22, with bore 28 extending through and between upper end portion 20*a* of tree-facing surface 20 and outwardly-facing surface 30 to form a through-hole that receives and supports a portion of fastener 14. A blind lower bore 32 extends through the lower end portion 20*b* of tree-facing surface 20, and is substantially parallel to bore 28. Lower bore 32 extends partially through lower end portion 20*b* but ends short of any opening into opening 22. Lower bore 32 receives and supports spike 16 so that the spike projects outwardly from lower end portion 20*b* of tree-facing surface 20 (FIG. 2). Thus, fastener 14 and spike 16 are positioned in respective bores 28, 32, and each extends or projects outwardly from a respective portion of tree-facing surface 20 of step body 12.

The opening 22 in step body 12 is sized to receive a part of a climber's hand so that the climber's fingers and/or a portion of the palm can be inserted through opening 22 to facilitate the climber's grip of the step body 12 at a lower portion 34 of body 12, which defines the lower part of opening 22 and thus acts as a handle. In the illustrated embodiment, opening 22 includes opposed, rack-receiving recesses 22*a* to facilitate placing tree climbing step 10 on a storage rack, as will be described below.

Step body 12 further includes a rearward or outboard portion 36 that supports a rear portion 14*b* of fastener 14. Outboard portion 36 of body 12 defines a bore 38 for receiving rear portion 14*b* of fastener 14. In the illustrated embodiment, bore 38 includes a forward reduced-diameter portion 38*a* and a rearward increased-diameter portion 38*b*, with an outwardly-facing shoulder or lip 39 marking the transition between the two (FIG. 2). Forward portion 38*a* of bore 38 directly supports fastener 14 so that the fastener can rotate and longitudinally translate around and along its longitudinal axis. The rearward increased-diameter portion 38*b* has a greater diameter than fastener 14 to provide space for a biasing element 40 in the form of a coil spring. Step body 12 is typically made from cast or machined metal, such as aluminum alloy, steel, or the like. However, it will be appreciated that substantially any sufficiently strong material may be used, including certain types of polymeric resins, fiber-reinforced or metal-reinforced plastics, or the like.

Coil spring 40 is disposed between rearward portion 14*b* of fastener 14 and rearward increased diameter portion 38*b* of bore 38 in outward portion 36 of body 12. The depth of the rearward increased-diameter portion 38*b* of bore 38 may be adjusted or selected according to the size of coil spring 40 and/or the desired amount of compression of the spring, as will be described below. Coil spring 40 is disposed along the shaft of fastener 14 at rearward portion 14*b*, and is at least partially received in the rearward increased-diameter portion 38*b* of bore 38, in the outboard portion 36 of step body 12. Coil spring 40 may be at least somewhat free to slide along fastener 14 and rearward portion 38*b* of bore 38, but once fastener 14 has been at least partially axially driven into a tree or pole (FIG. 8), spring 40 is held in compression between head portion 48 and an outwardly-facing surface such as shoulder 39 (FIG. 2). Optionally, a biasing element or spring could be disposed substantially anywhere along the fastener, and held in compression or in tension (depending on the location and manner in which it engages the body), to achieve substantially the same effect of biasing the body toward the tree once the tip portion of the fastener has been driven in to initial engagement with the tree.

As described above, fastener 14 includes tip portion 14*a*, which is at least partially threaded and received in bore 28, and rearward portion 14*b*, which is received in bore 38. Tip portion 14*a* includes a sharpened tip 42 and a continuous spiral thread 44, which may continue substantially all the way to sharpened tip 42, or which may terminate before reaching sharpened tip 42, as shown. Sharpened tip 42 allows the tip portion 14*a* of fastener 14 to readily penetrate the outer surface of a tree or tree bark by simply thrusting the fastener against the tree, without need for initially rotating the fastener. Spiral thread 44 allows fastener 14 to be substantially rotated to draw at least the fastener's tip portion 14*a* further into the tree. Similarly, spike 16 includes a sharpened tip 46 to facilitate penetration of the tree. Fastener 14 and spike 16 are typically made of metal, such as steel, so that they can be repeatedly driven into wood or similar surfaces without bending or loosing significant sharpness of their respective tips.

Located at rearward portion 14*b* of fastener 14 is a head portion 48 that, in the illustrated embodiment, is a hexagonal bolt head having a diameter that is greater than that of the shaft of fastener 14. Optionally, the head portion may be substantially any feature that facilitates rotation of the fastener via a tool, such as any non-circular outer surface, or a non-circular recess or cavity for receiving a tool such as a hexagonal wrench, a screwdriver, or the like. Optionally, the head portion could facilitate manipulation by hand, such as by including a pair of radially extending projections or wings (i.e., similar to a wing nut) of sufficient size to enable a climber to grasp the head portion and apply sufficient torque to rotate the fastener by hand and drive it into the tree or pole. In the illustrated embodiment, head portion 48 is positioned outboard of the outward portion 36 of step body 12, although it will be appreciated that the head portion could be positioned elsewhere along the shaft of fastener 14, such as along a mid portion that is accessible through opening 22 in step body 12.

Figure 2A:
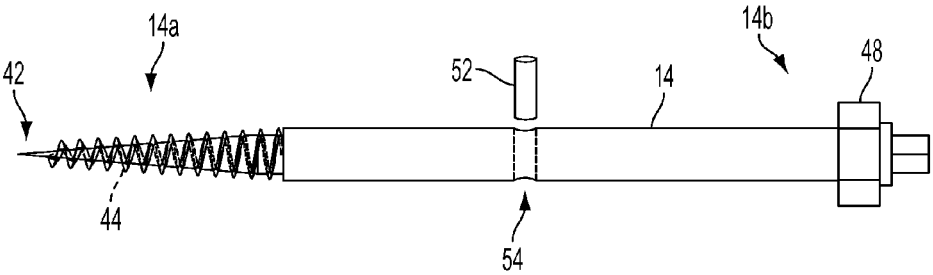
FIG. 2A is a partially-exploded side elevation of the fastener of FIG. 2.
Figure 8:
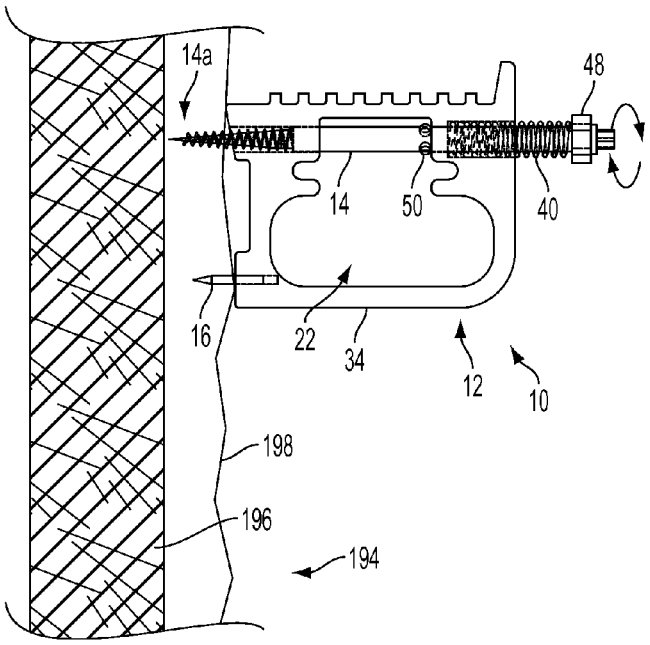
FIG. 8 is a side and partial sectional elevation of the climbing support and tree of FIG. 7A, with the climbing support shown initially supported at an outer surface of the tree.

A pair of radial projections 50 (FIGS. 1-2A) are disposed along the mid-section of fastener 14, in the region of opening 22 of step body 12. Projections 50 prevent tip portion 14*a* of fastener 14 from retracting fully into bore 28 as the climbing step 10 is thrust against a tree (FIG. 8). Radial projections 50 are sized so that they cannot pass through the forward reduced diameter portion 38*a* of bore 38. In the illustrated embodiment, radial projections 50 are the opposite end portions of a cylindrical shaft 52 having a length greater than the diameter of fastener 14, the cylindrical shaft 52 being disposed in a bore 54 that extends laterally through the fastener 14 (FIG. 2A). Once fastener 14 has been axially slid into bore 38 to a position as shown in FIG. 2, the cylindrical shaft 52 is inserted into the lateral bore 54 of fastener 14 and aligned so that its opposite ends form the radial projections 50. The cylindrical shaft 52 may then be permanently or removably mounted in lateral bore 54, such as by welding, brazing, with an adhesive, with screw threads, by press-fitting or interference-fitting, or the like. Once cylindrical shaft 52 is in place in lateral bore 54 along fastener 14, the fastener is effectively locked at step body 12, since the radial projections cannot be drawn through the forward reduced diameter portion 38*a* of bore 38, the radial projections cannot be drawn through the bore 28, and the head portion 48 cannot be drawn through any of the bores in step body 12.

The respective diameters of bore 28 and forward reduced-diameter portion 38*a* of bore 38 are approximately equal to, or slightly greater than, the diameter of fastener 14, so that the fastener can move freely except as limited by head portion 48 and radial projections 50. Radial projections 50 are positioned along fastener 14 so that they will contact a forward-facing inner surface 56 of step body 12 (FIG. 8), which defines a portion of opening 22 opposite outwardly-facing surface 30. When fastener 14 moves axially rearwardly relative to step body 12, radial projections 50 contact forward-facing inner surface 56 to limit any further axial rearward travel of the fastener, so that at least a portion of the tip portion 14*a* (including sharpened tip 42) of fastener 14 still projects from upper end portion 20*a* of tree-facing surface 20 of the step body 12. Once radial projections 50 contact the forward-facing inner surface 56, sharpened tip 42 of fastener 14 is approximately aligned directly above sharpened tip 46 of spike 16, so that the spike and fastener may be initially driven approximately the same distance into the outer surface of a tree or pole as the climbing step is thrust against the tree (FIG. 8).

Figure 4:
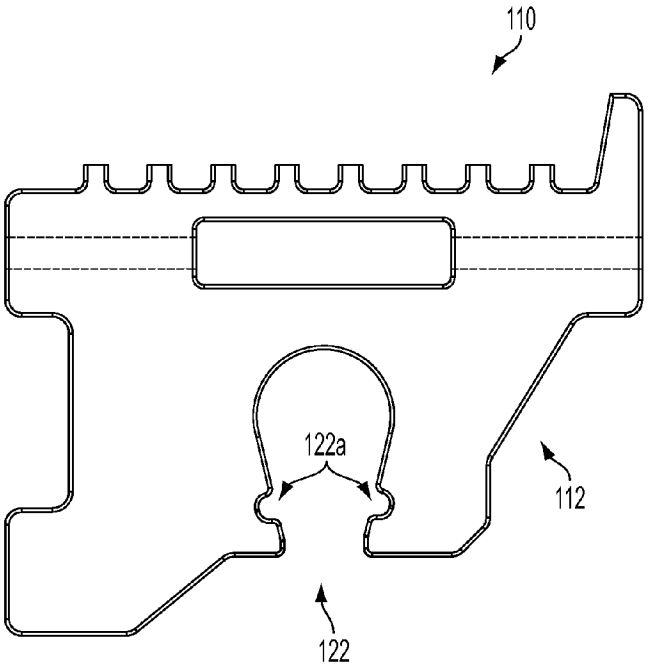
FIG. 4 is a side elevation of the body portion of the climbing support of FIG. 3.
Figure 3:
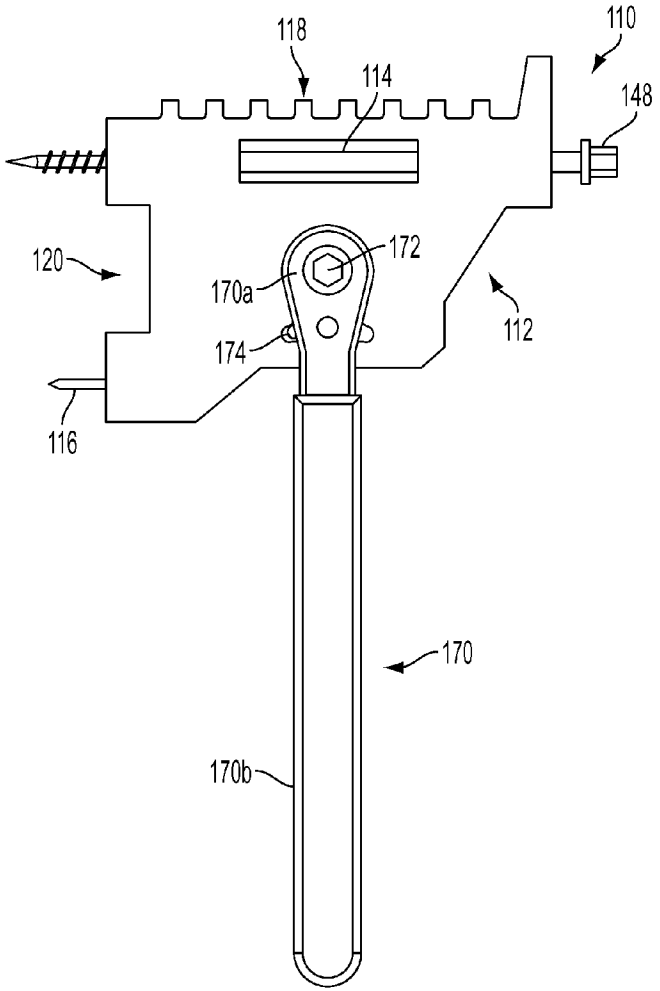
FIG. 3 is a side elevation of another climbing support in accordance with the present invention.

The alternative tree climbing step 110 may be substantially similar to tree climbing step 10 described above, including a step body 112, a fastener 114, and spike 116, an upper support surface 118, a tree-facing surface 120, etc. (FIGS. 3 and 4). Step body 112 defines an opening or recess 122 that is sized and shaped to receive a fastener-engaging head portion 170*a* of a tool 170 (FIG. 3). In the illustrated embodiment, tool 170 is a ratchet wrench with a handle portion 170*b* for applying a torque to the fastener 114 via fastener-engaging head portion 170*a* (FIGS. 3 and 7B). Head portion 170*a* includes a hexagonal socket or recess 172 (FIG. 3) for receiving the head portion 148 of fastener 114. Head portion 170*a* of tool 170 further includes a direction-control switch 174 that extends from one side or the other of head portion 170*a* according to whether the tool 170 is set for tightening or loosening the fastener 114. The opening or recess 122 in step body 112 includes additional recesses 122*a* for receiving switch 174 in either position. However, it will be appreciated that the tool-receiving opening or recess could be sized and shaped to receive substantially any tool head.

Head portion 170*a* of tool 170 may be inserted from either side (i.e., laterally) of step body 112 and into opening 122 (FIG. 3). In this arrangement, with head portion 170*a* of tool 170 received in opening 122 of step body 112, the combined tree climbing step 110 and tool 170 may be wielded like a hammer, with handle portion 170*b* of tool 170 acting as the hammer handle, and with tree climbing step 110 acting as the hammer head, as will be described below. Although not shown in FIGS. 3 and 4, it will be appreciated that tree climbing step 110 may include numerous other features or aspects of tree climbing step 10, including an opening or slot for receiving a rack, a coil spring or other biasing element at the rearward portion of the fastener, and radial projections along the fastener shaft, for example.

The tree-climbing steps described above may be made of substantially any sufficiently strong material that is resistant to corrosion in the presence of outdoor weather, tree sap, etc. For example steel, aluminum alloy, or fiber-filled resinous plastic may be used. If desired, the tree-climbing steps can be finished or molded in bright colors for high visibility, or in muted tones or camouflage patterns for blending in to the natural surroundings.

Figure 5:
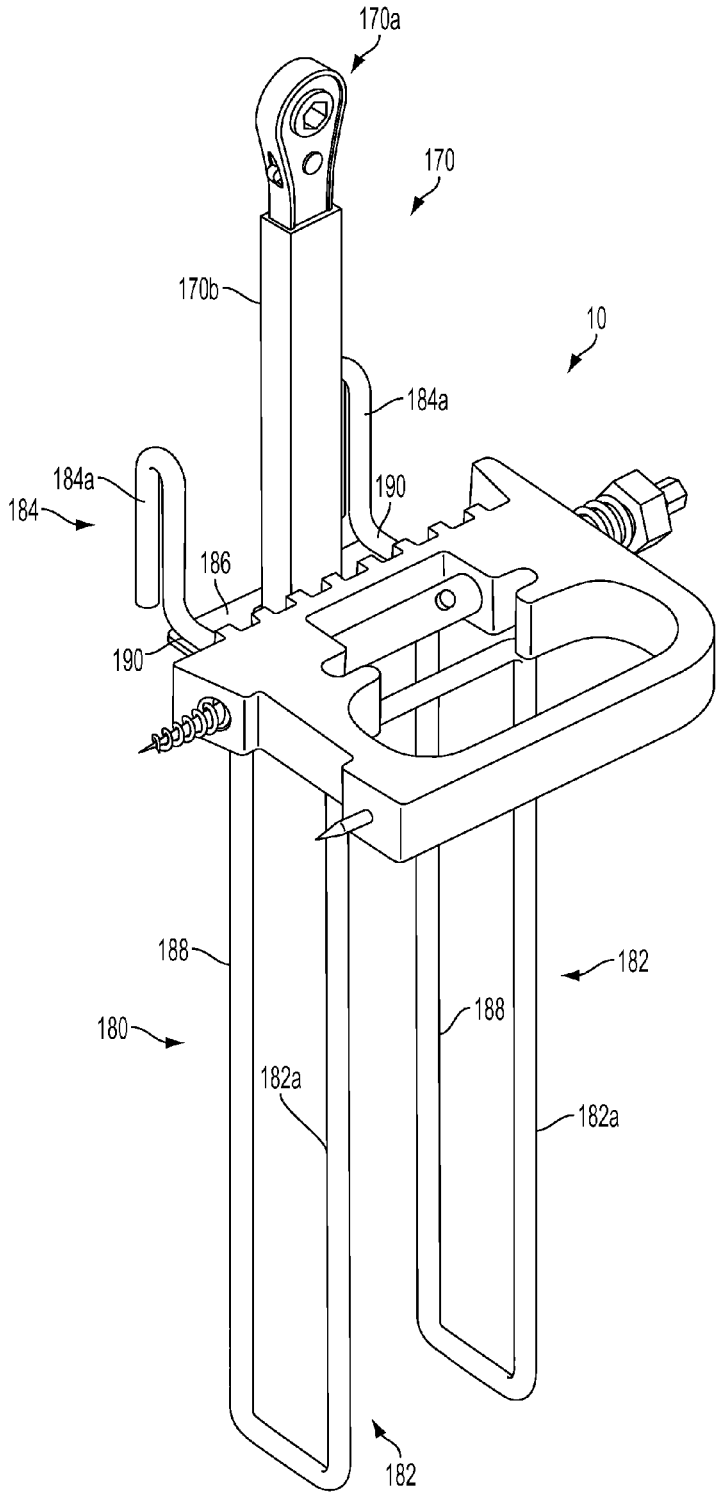
FIG. 5 is a perspective view of the climbing support of FIG. 1, positioned at a support rack, and including a tool for rotatably driving the fastener of the climbing support.
Figure 6:
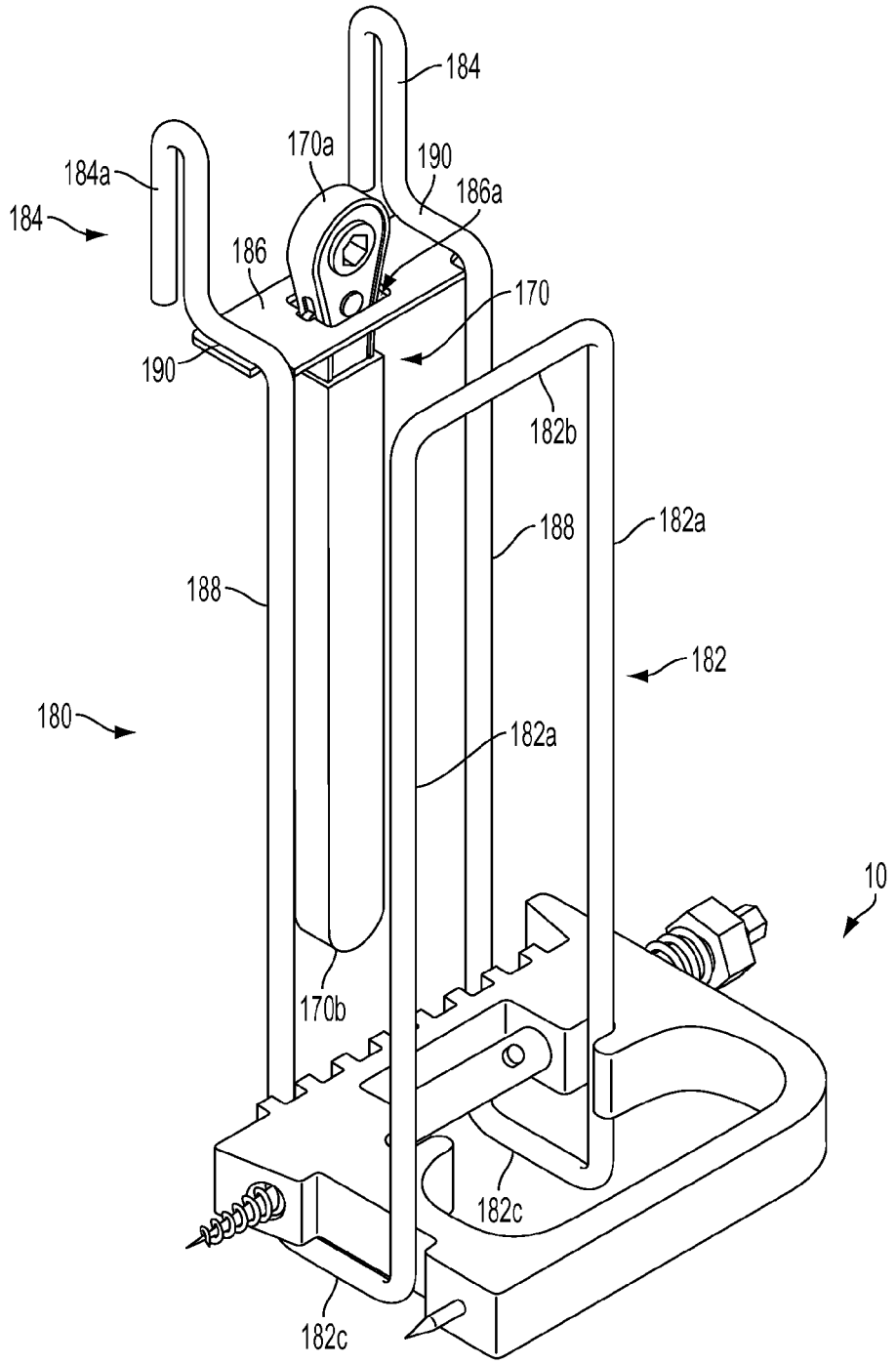
FIG. 6 is a perspective view of the climbing support, tool, and support rack of FIG. 5, shown with the tool and climbing support installed on the support rack.

Referring now to FIGS. 5 and 6, a storage arrangement is shown for use in combination with tree climbing step 10 and tool 170, although it will be appreciated that alternative tree climbing step 110 could also be adapted for use in the same storage arrangement. A support rack 180 includes a step-supporting portion 182, a mounting portion 184, and a tool-supporting portion 186. Step-supporting portion 182 includes a pair of spaced rods 182*a* aligned substantially vertically and joined to one another at their upper ends by an upper cross bar 182*b*, with a pair of generally horizontal base members 182*c* coupled to respective ones of the vertical rods 182*a*. Another pair of generally vertical rods 188, each corresponding to a respective horizontal base member 182*c*, couple the step-supporting portion 182 to the mounting portion 184 of support rack 180. Mounting portion 184 includes a pair of inverted U-shaped portions 184*a*, each coupled to a respective one of the vertical rods 188 via a respective horizontal rod portion 190. Each inverted U-shaped portion 184A of mounting portion 184 is open at its bottom end to receive a wearer's belt or waistband, so that support rack 180 and a plurality of tree climbing steps 10 in stacked arrangement can be carried in a hands-free manner by a climber.

Tool-supporting portion 186 of support rack 180 is a generally planar horizontal plate that is coupled to and spans between each horizontal rod portion 190, as shown in FIG. 6. Tool-supporting portion 186 defines an opening 186*a* that is large enough to receive the handle portion 170*b* of tool 170, but small enough so that the tool 170 can be supported by its head portion 170*a* at the tool-supporting portion 186 of support rack 180. Opening 186*a* of tool supporting portion 186 is spaced sufficiently from substantially vertical rods 188 so that the handle portion 170*b* of tool 170 does not interfere with the stacking of tree climbing steps 10 along the step supporting portion 182.

The vertical rods 182*a* of step-supporting portion 182 are sized and spaced to be received in the respective rack-receiving recesses 22*a* of opening 22 in step body 12. The space defined between vertical rods 188 and vertical rods 182*a* is such that the portion of step body 12 between rack-receiving portions 22*a* and upper support surface 18 is received between the vertical rods 188, 182*a*. In the illustrated embodiment, the center of gravity of tree climbing step 10 is located at or near the rack-receiving portions 22*a* of opening 22, so that the tree climbing step 10 will generally balance in substantially horizontal alignment when resting on horizontal base members 182*c* of step supporting portion 182, such as shown in FIG. 6. It will be appreciated that a plurality of tree climbing steps 10 may be stacked, one atop the other, along the step-supporting portion 182 of support rack 180, and worn on a climber's belt so that the climber can remove the tree climbing steps 10, one at a time, allowing the steps to be installed on a tree as the climber ascends.

Accordingly, the present invention provides a climbing support, such as a tree climbing step, that can be installed one-handed, such as by a climber while progressively scaling a tree. As will be described in greater detail below, the tree climbing step is initially driven or thrust against the outer surface of the tree, in a direction that is generally orthogonal to the tree, to at least partially embed the respective tips of the fastener and the spike in the tree's outer surface. This temporarily supports the climbing step at the tree, which permits the climber to release his/her grasp of the climbing step, retrieve the tool such as a ratchet wrench, and rotatably drive the fastener using the tool (or using the climber's bare hand or a gloved hand) to fully secure the step at the tree by tightening the fastener. This draws the tree climbing step tightly against the outer surface of the tree, so that the step can bear the weight of the climber.

Figure 7A:
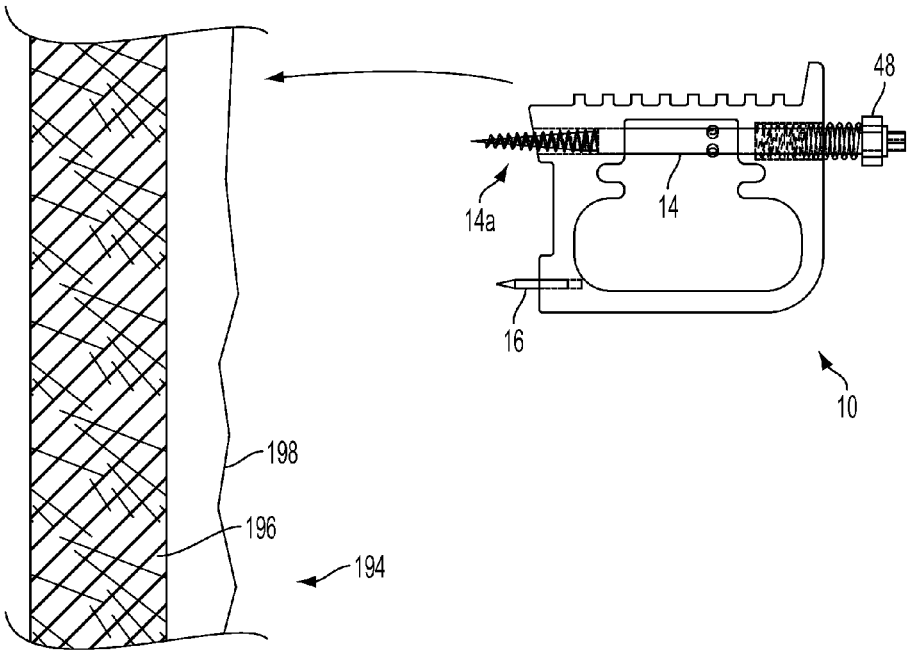
FIG. 7A is a side and partial sectional elevation of the climbing support of FIG. 1, which is shown being thrust toward the side of a tree.
Figure 7B:
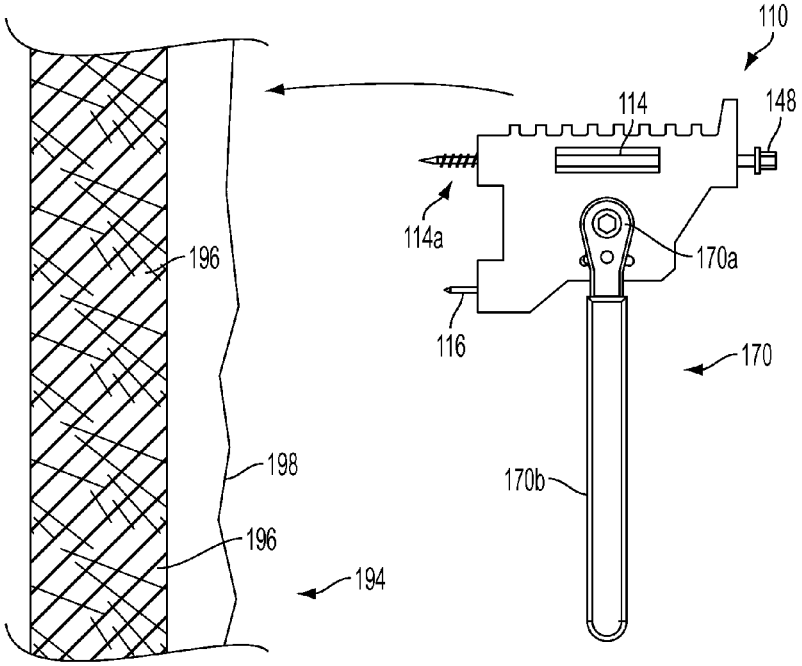
FIG. 7B is a side and partial sectional elevation of the climbing support of FIG. 3, which is shown being thrust toward the side of a tree.

As noted above, the initial step of installing the climbing support of the present invention is to first manually drive or thrust the step against the outer surface of a tree 194, which includes an inner wood or fiber portion 196 and an outer bark portion 198 (FIG. 7A). Tree climbing step 10 is configured to be grasped at the opening 22 in body 12 and to be thrust or driven against the tree 194, typically in an overhand stabbing motion (FIG. 7A), although virtually any other motion could be used, depending on the location and preference of the climber. This sets the climbing step 10 at least partially into the bark portion 198 with the tip portion 14*a* of the fastener 14 and the spike 16 at least partially embedded in the bark 198 (FIG. 8). It will be appreciated that the alternative tree climbing step 110 may be initially set into tree 194 using a similar motion, but by grasping the handle portion 170*b* of tool 170 to wield the combined tool and climbing step as a hammer, thereby obtaining a leverage advantage in setting the climbing step 110 against the tree 194. Once the tree climbing step 110 is initially set into the tree, the climber can remove the tool 170 from step body 112 and use it to rotate the fastener 114.

Figure 9:
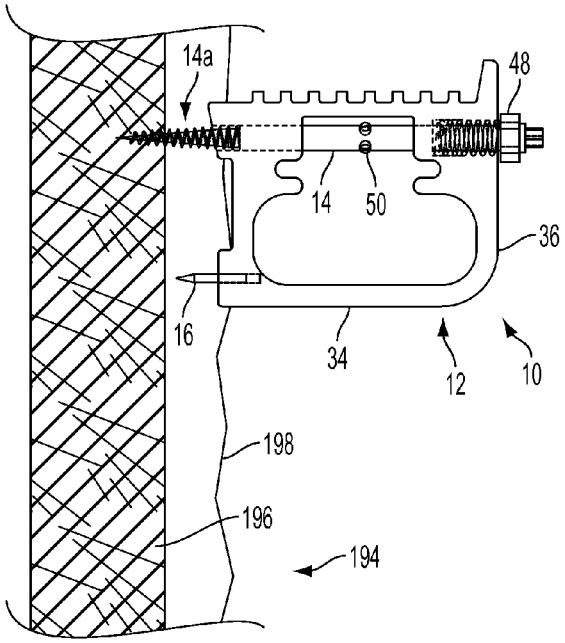
FIG. 9 is a side and partial sectional elevation of the climbing support and tree of FIG. 7A, with the climbing support shown fully engaged and supported at the tree.

Once the tree climbing step 10 (or alternative step 110) is initially supported at the tree 194, coil spring 40 urges step body 12 against the bark 198, which helps to maintain spike 16 in engagement with the bark 198 to limit or prevent rotation of step body 12 as the climber applies torque to head portion 48 of fastener 14. This torque (indicated by curved arrows in FIG. 8) drives tip portion 14*a* further into the tree, and into the wood portion 196, to draw climbing step 10 tightly against tree 194 (FIG. 9). Tightening the fastener 14 causes the upper end of upper end portion 20*a* of tree-facing surface 20, which projects further toward the tree than the rest of tree-facing surface 20, to act as a fulcrum, thus helping to draw spike 16 further into the tree 194 as the fastener is tightened. The tightening of fastener 14 also compresses spring 40 until head portion 48 is drawn tightly against the outward portion 36 of step body 12, at which point further tightening of the fastener 14 may draw at least the upper and lower end portions 20*a*, 20*b* of tree-facing surface 20 into the bark 198, depending on the bark's softness.

Thus, the tree climbing step of the present invention can be installed along a tree, wooden pole, or the like, in a one-handed manner, by initially setting the climbing step into the tree, typically with an overhand motion, and then using a single hand to rotate the fastener to tightly secure the step at the tree. Once the climbing step is fully secured, the lower portion of the step body and the opening may be used as hand-hold and/or foot-hold, and the upper support surface may also be used as a hand-hold or foot-support as a climber scales a tree or other surface to which the climbing step is attached. It will be appreciated that the climbing step can also be removed in a one-handed manner, by initially loosening the fastener until it mostly or entirely disengages the tree, and then manually pulling the climbing step away from the tree to disengage the spike.

Figure 10:
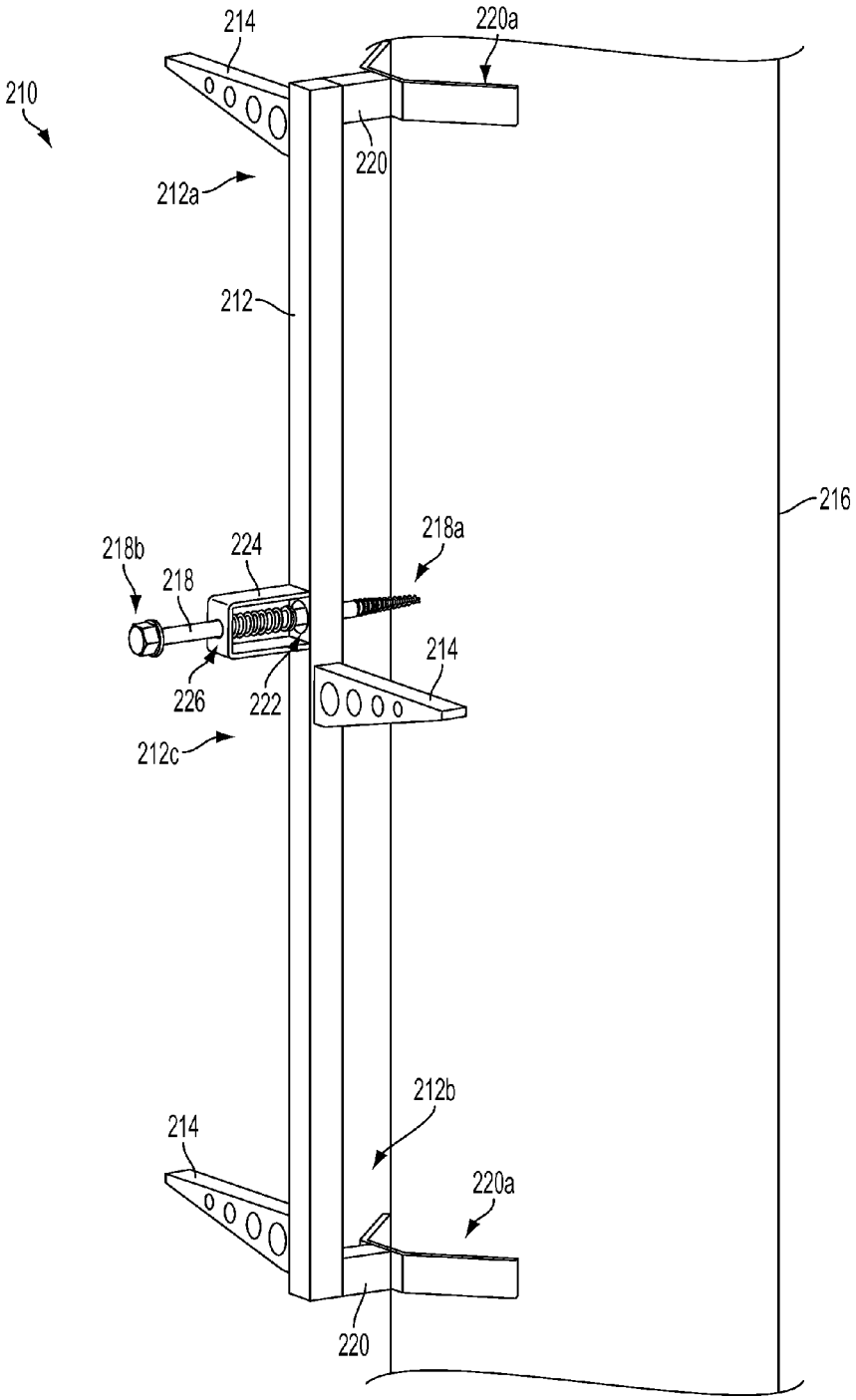
FIG. 10 is a perspective view of another climbing support in accordance with the present invention, which is shown positioned against the side of a tree or pole.
Figure 11:
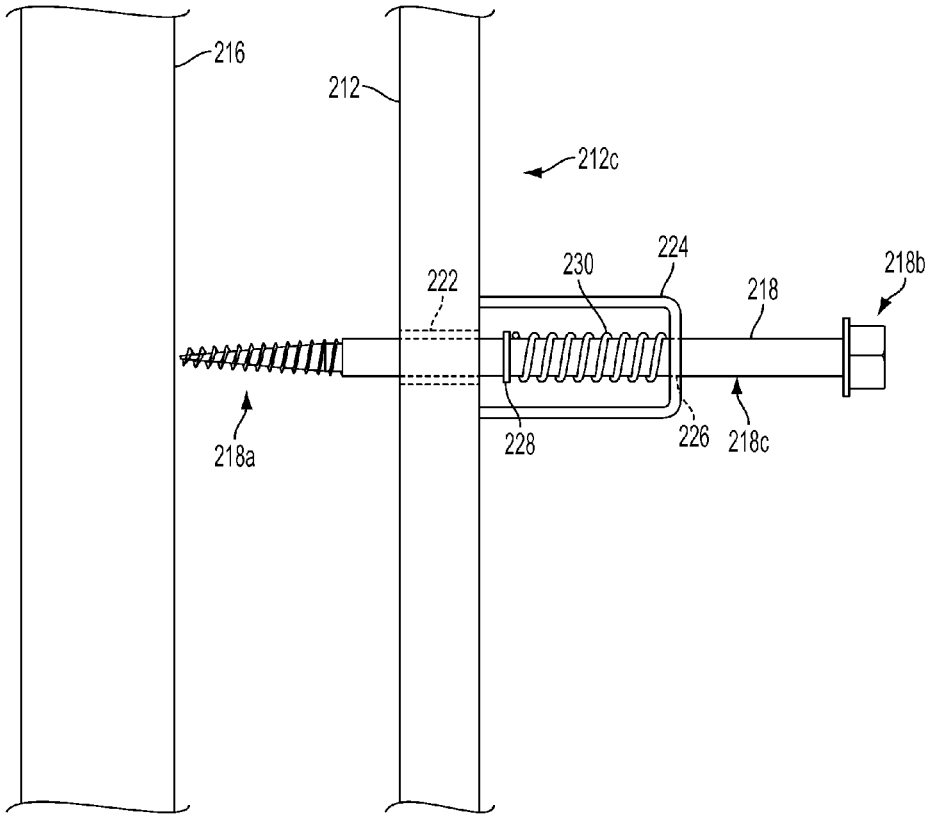
FIG. 11 is an enlarged side elevation of an attachment portion of the climbing support of FIG. 10.

Optionally, and with reference to FIGS. 10 and 11, a tree climbing apparatus or assembly 210 includes an elongate body 212 that supports a plurality of steps or step portions 214 defining upper support surfaces for a user to grasp or step upon. Tree climbing apparatus 210 can be mounted to a tree or pole 216 via a fastener 218 having a threaded tip portion 218*a* and a head portion 218*b*. A standoff 220 projects or extends perpendicularly outwardly from each opposite end 212*a*, 212*b* of the elongate body 212 and engages the tree 216 with a generally C-shaped tree-engaging portion or yoke 220*a* (FIG. 10). Standoffs 220 spaces elongate body 212 and steps 214 outwardly away from the tree 216 to provide adequate room between the tree 216 and the steps 214 and elongate body 212, so that a user can readily grasp these components of the tree climbing apparatus with the hands and place a foot solidly on each step 214. Standoffs 220 also limit or prevent rotation of elongate body 212 during rotation of fastener 218.

In the illustrated embodiment, fastener 218 is permanently or semi-permanently mounted in a bore 222 in a middle region 212*c* of elongate body 212, and can be manually axially driven into the tree 216 without the use of tools, as described below. A generally C-shaped housing or fastener-support member 224 extends outwardly from elongate body 212 away from tree 216, in the vicinity of bore 222, and supports fastener 218 with the fastener's head portion 218*b* positioned outwardly of support member 224. As fastener 218 is rotatably driven into tree 216, head portion 218*b* will be drawn closer to fastener-support member 224, typically until making contact, so that further rotation of the fastener causes head portion 218*b* to apply a force to the support member 224, which thereby urges the tree-climbing apparatus 210 toward the tree. The tightening of the fastener 218 also urges C-shaped portions 220*a* of standoffs 220 into tighter contact with the tree, so that the apparatus 210 is held tightly against the tree with little or no movement during use, and with fastener 218 and standoffs 220 all providing both vertical support and lateral support for elongate body 212 and steps 214 as the fastener and standoffs engage the tree 216.

Fastener 218 includes a generally smooth shaft portion 218*c* between tip portion 218*a* and head portion 218*b* (FIG. 11). Shaft portion 218*c* is received in bore 222 of elongate body 212, and also in a bore 226 in fastener-support member 224. Shaft portion 218*c* supports or includes a flange or washer or clip 228 (such as a C-clip that engages a circumferential groove in the shaft portion of the fastener). Clip 228 has a greater diameter than shaft 218*c* and bore 226 so that the movement of fastener 218 is limited by the clip 228 in one direction and by the head portion 218*b* in the other direction when they contact fastener-support member 224 at bore 226. A coil spring 230 is disposed around shaft portion 218*c* between clip 228 and fastener-support member 224, and is compressible by grasping head portion 218*a* and pulling fastener 218 rearwardly away from elongate body 212, so that tip portion 218*a* is drawn away from the tree 216. By releasing the fastener, the energy stored in spring 230 is released to propel or drive fastener 218 toward the tree 216, to thereby embed at least part of the tip portion 218*a* into the surface of the tree. With the fastener tip portion 218*a* at least partially embedded, fastener 218 can be rotated by applying torque to head portion 218*b* with a tool, until head portion 218*b* is tightened against fastener-support member 224 sufficiently as to substantially preclude vertical or lateral movement of the tree-climbing apparatus 210 as it is being scaled by a climber.

Thus, tree-climbing apparatus 210 may be installed along a tree by orienting the apparatus 210 generally vertically along the tree 216, setting the standoffs 220 against the tree's outer surface, and driving the fastener 218 into the tree. The fastener 218 is driven into the tree by grasping head portion 218*a*, drawing the fastener away from the tree to compress spring 230, and releasing the head portion 218*b* so that the fastener's tip portion 218*a* is driven some distance into the tree by spring 230. The fastener 218 is then rotated to further drive it into the tree until standoffs 220 are urged tightly against the tree and the climbing apparatus 210 is secure. Optionally, multiple tree-climbing apparatuses 210 may be positioned one atop the other to facilitate climbing a tree of substantially any height. The tree-climbing apparatus 210 may be readily removed from the tree simply by loosening the fastener 218, and without reaching around the tree to loosen straps or other attachment devices.

Referring now to FIGS. 12-21, another tree-climbing apparatus or assembly 310 is similar in many respects to apparatus 210, described above, but is configured for improved portability and compactness. Like tree-climbing apparatus 210, tree-climbing apparatus 310 includes an elongate body 312 with a plurality of steps or step portions 314 spaced vertically from one another and on alternating sides of the elongate body 312. Tree-climbing apparatus 310 is attachable to a tree or pole 316 in a similar manner as apparatus 210, and includes fasteners 318 and standoffs 320 for this purpose.

Figure 19:
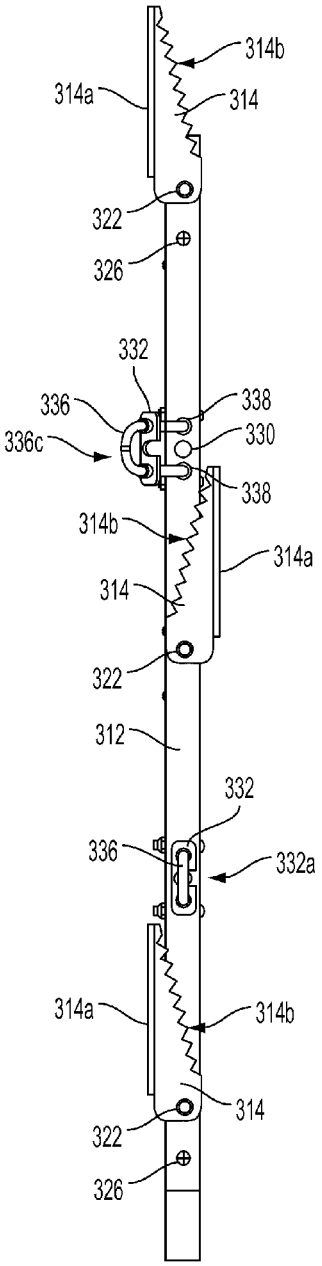
FIG. 19 is a front elevation of the climbing support of FIG. 16, shown in a transport configuration and with fasteners omitted.
Figure 20:
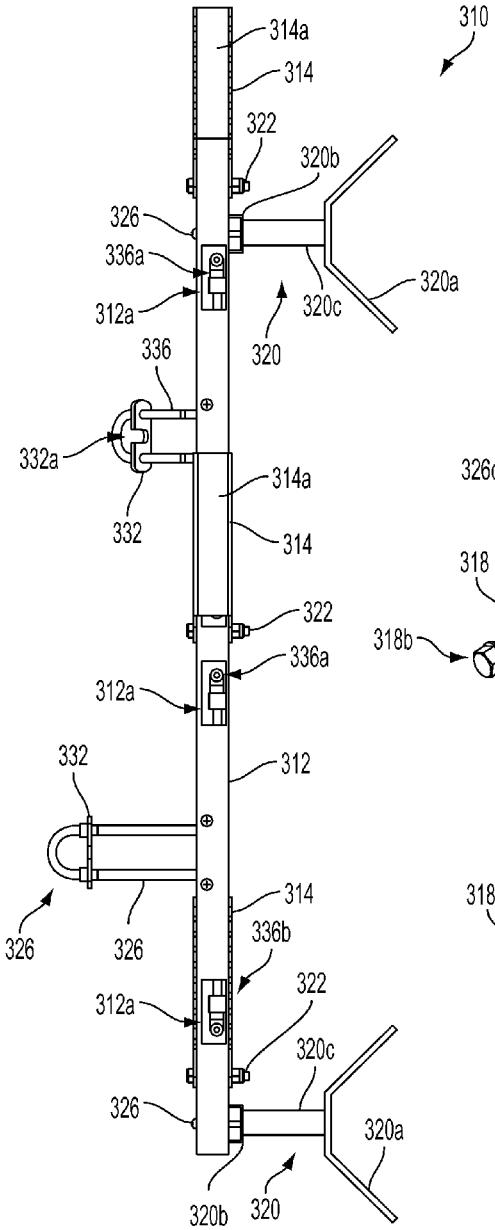
FIG. 20 is a side elevation of the climbing support of FIG. 19.
Figure 21:
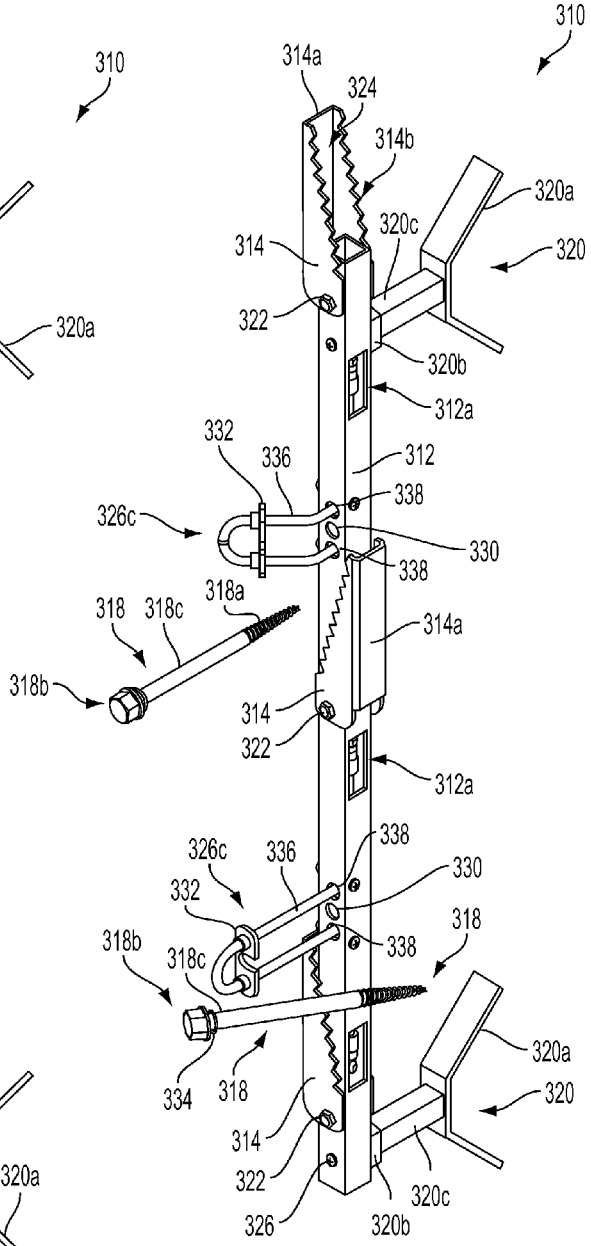
FIG. 21 is a perspective view of the climbing support of FIG. 19, with fasteners shown prior to installation.

To facilitate storage, compactness, and portability when the apparatus is not in use, steps 314 are pivotably mounted to elongate body 312 via respective fasteners 322, and are formed with channels 324 (FIGS. 12, 13, and 21) that face inwardly to receive elongate body 312 when pivoted upward to a storage or transport position (FIGS. 19-21). Channels 324 face upwardly when steps 314 are pivoted to a horizontal use position (FIGS. 12-16). Steps 314 are generally U-shaped in cross section to define the upwardly-facing channels 324 in the use position, with upper support surfaces for supporting a user's hand or foot. Steps 314 include a bottom plate portion 314*a* that contacts elongate body 312 to limit the pivot angle of each step 314 so that step surfaces 314*b* are generally horizontal when in the use position. Optionally, fasteners 322 may be adjusted (tightened or loosened) to adjust the degree of frictional resistance to pivoting movement of steps 314 to elongate body 312, so that each step 314 will tend to remain in either its transport position or its horizontal use position until it is intentionally repositioned by the user. Friction elements such as resinous plastic washers or the like may be positioned along each fastener, between surfaces of each step 314 and elongate body 312, to facilitate frictional adjustments.

Figure 17:
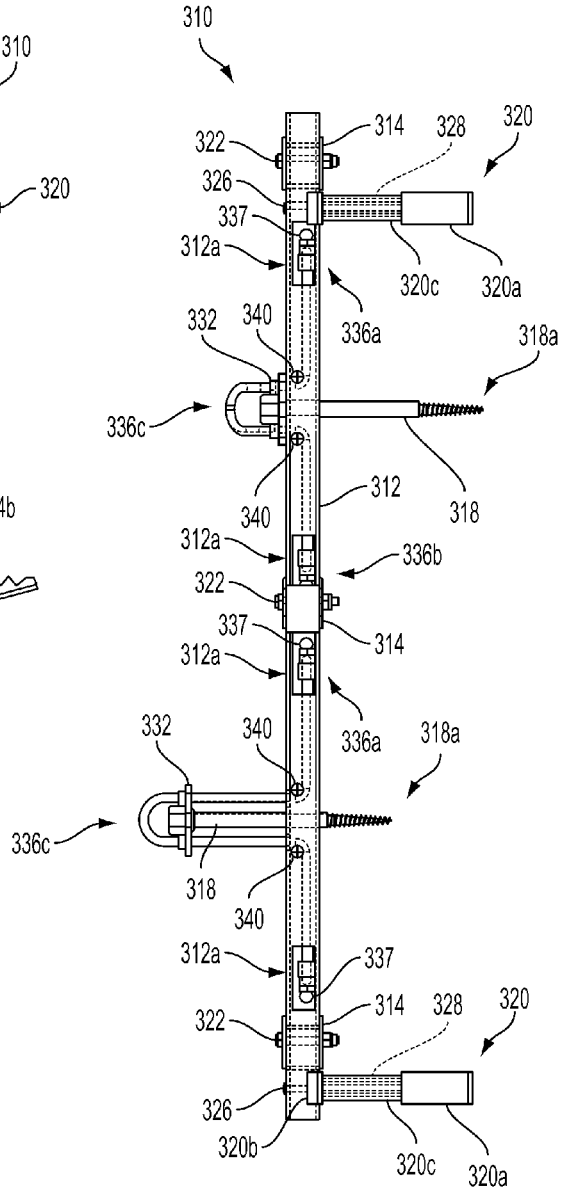
FIG. 17 is a side elevation of the climbing support of FIG. 16, showing internal components in phantom.
Figure 18:
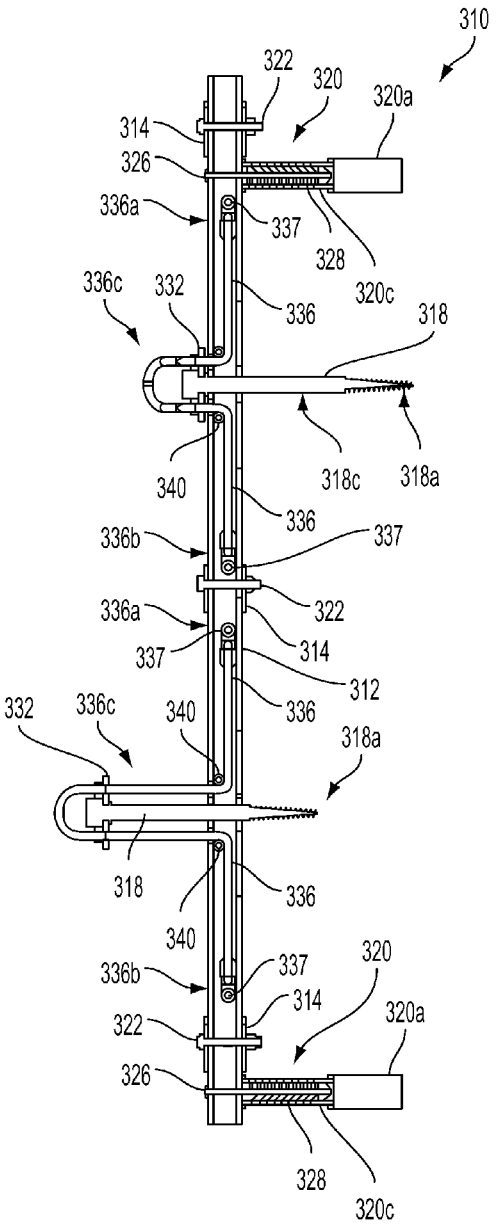
FIG. 18 is a side sectional view of the climbing support, taken along section line XVIII-XVIII in FIG. 16.

Standoffs 320 are rotatable from a use position in which generally C-shaped tree-engaging portions 320*a* are oriented in a substantially horizontal plane, perpendicular to elongate body 312 (FIGS. 12-18), to a storage or transport position in which the tree-engaging portions 320*a* are oriented in a substantially vertical plane, parallel to elongate body 312 (FIGS. 19-21). Thus, when steps 314 and standoffs 320 are in their respective storage or transport positions, the tree-climbing apparatus 310 is only slightly wider overall than the width of elongate body 312. As best shown in FIGS. 17 and 18, standoffs 320 are mounted to elongate body 312 by respective fasteners 326 that extend through the elongate body and into a hollow tubular horizontal extension 320*c*, which houses a spring 328 that is disposed around fasteners 326 and held in compression. Springs 328 bias the standoffs 320 toward the elongate body 312 in both the use and storage positions, but allow standoffs 320 to be manually pulled away from elongate body 312 for rotation.

Figure 12:
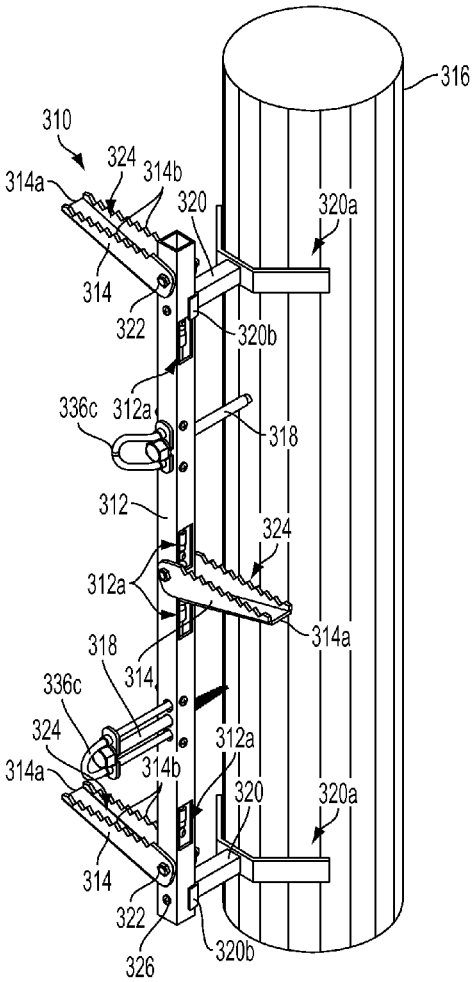
FIG. 12 is a perspective view of another climbing support in accordance with the present invention, which is shown positioned against the side of a tree or pole.
Figure 13:
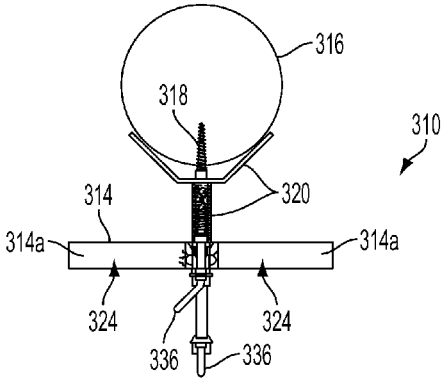
FIG. 13 is a top plan view of the climbing support and pole of FIG. 12.
Figure 14:
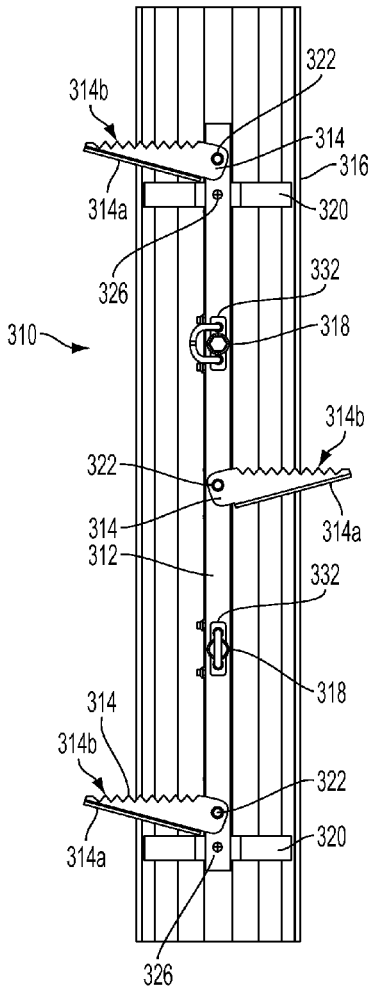
FIG. 14 is a front elevation of the climbing support and pole of FIG. 12.
Figure 15:
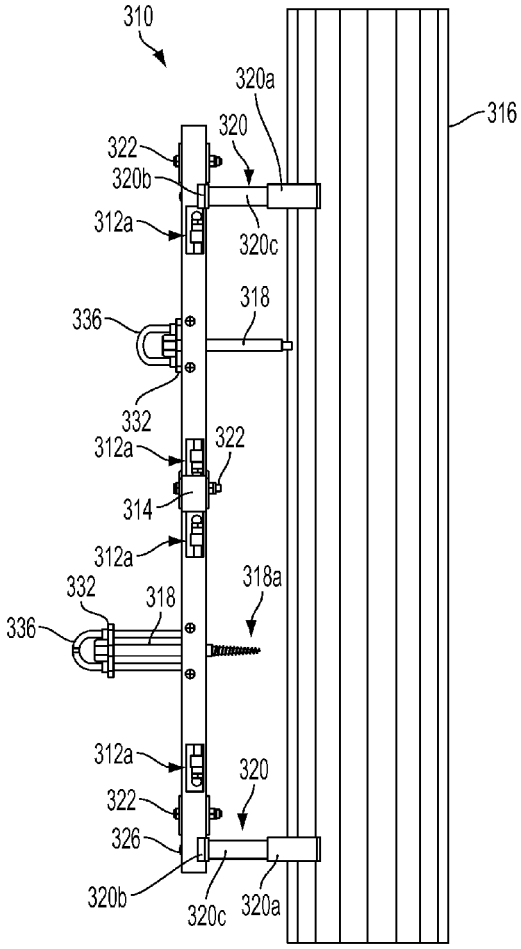
FIG. 15 is a side elevation of the climbing support and pole of FIG. 12.
Figure 16:
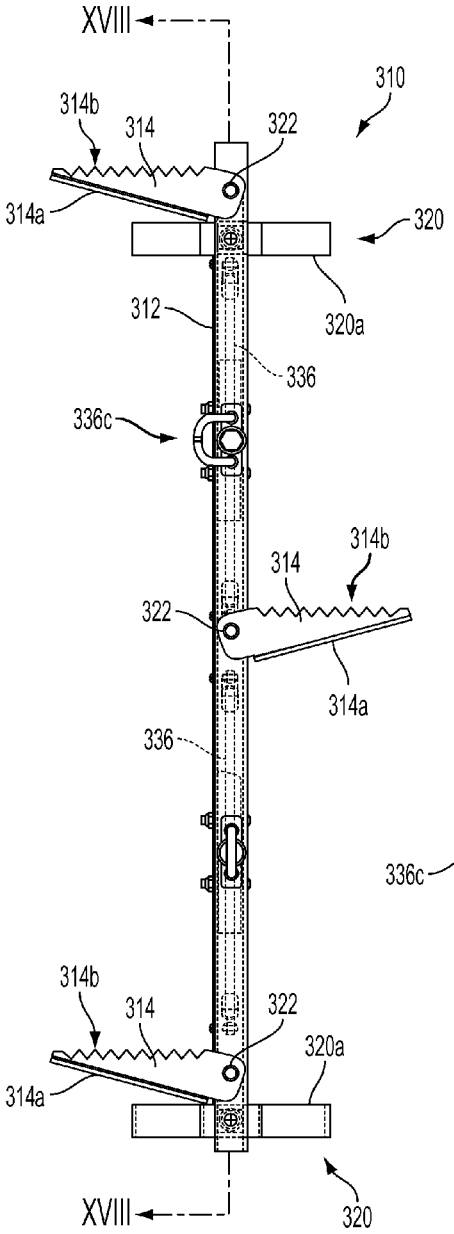
FIG. 16 is another front elevation of the climbing support of FIG. 12, showing internal components in phantom.

Standoffs 320 further include body-receiving bracket portions 320*b*, located opposite C-shaped tree-engaging portions 320*a*, and which are also generally C-shaped. Bracket portions 320*b* receive a portion of elongate body 312 when the standoffs 320 are in the use position, such as shown in FIGS. 12, 15, and 17. Bracket portions 320*b* thus prevent the standoffs 320 from rotating to the storage position unless the standoffs are first manually pulled away from elongate body 312, against the biasing force of springs 328, to disengage the elongate body 312 from the bracket portions 320*b*. Once the standoffs 320 are rotated to the storage/transport position of FIGS. 19-21 and released, springs 328 bias standoffs 320 toward elongate body 312 so that bracket portions 320*b* rest against the tree-facing surface of elongate body 312, but with the elongate body 312 remaining disengaged from the channels defined by the bracket portions 320*b*. Standoffs 320 may then be manually rotated toward the use position, with or without first pulling the standoffs 320 away from elongate body 312, until bracket portions 320*b* are substantially aligned with elongate body and springs 328 are permitted to bias the standoffs 320 back into engagement with elongate body 312 positioned in the channels defined by bracket portions 320*b*.

The fasteners 318 of apparatus 310 are configured to be readily removable from elongate body 312 when desired, such as for safer transport of the apparatus without sharp fastener tips projecting out from the elongate body. Fasteners 318 include threaded tip portions 318*a* and head portions 318*b*, with middle portions 318*c* that are received in a bore 330 (or in a pair of corresponding bores since, in the illustrated embodiment, elongate body 312 is tubular). A generally C-shaped collar plate 332 includes a center channel 332*a* (FIGS. 19-21) that receives fastener middle portion 318*c* near head portion 318*b*. A flange or washer or C-clip 334 (FIG. 21), which has a larger diameter than fastener middle portion 318*c*, is positioned on middle portion 318*c* and spaced sufficiently from head portion 318*b* so that collar plate 332 can be positioned between head portion 318*b* and C-clip 334.

An elongate elastic cord or biasing element 336 has opposite end portions 336*a*, 336*b* that are attached inside of the tubular elongate body 312 with fasteners 337 (FIGS. 17 and 18), and a middle loop portion 336*c* that exits elongate body 312 through bores 338 located on either side of the bore 330 for fastener 318. End portions 336*a*, 336*b* are accessible through openings 312*a* (FIGS. 12, 15, 17, 20, and 21) in elongate body 312, so that elastic cord 336 can be readily replaced if desired. Respective bearing surfaces or roller members 340, which are mounted inside of elongate body 312 at each bore 338, guide elastic cord 336 around an approximately 90-degree bend between end portions 336*a*, 336*b* and middle loop portion 336*c*, to limit or prevent abrading the cord on the edges of bored 338 (FIGS. 17 and 18). Collar plate 332 is coupled to (or threaded onto) middle loop portion 336*c* of elastic cord 336, and may only loosely or frictionally engage the cord, or may be clamped tightly onto the cord so that the collar plate cannot slide along the cord.

Elastic cord 336 biases fastener 318 so that tip portion 318*a* is urged away from elongate body 312, such as shown with reference to the upper fastener and elastic cord in FIGS. 12, 15, 17, and 18. Fastener 318 may be pulled or drawn in the opposite direction, with head portion 318*b* drawn away from elongate body 312, such as shown with reference to the lower fastener and elastic cord in FIGS. 12, 15, 17, and 18, by grasping any one or combination of fastener 318 (particularly head portion 318*b*), collar plate 332, and/or the middle loop portion 336*c* of elastic cord 336. For example, it may be convenient for a user to insert one or more fingers through the portion of loop portion 336*c* located outboard of collar plate 332, for pulling back on the cord 336, which draws fastener 318 rearwardly due to the engagement of collar plate 332 between the fastener's head portion 318*b* and C-clip 334.

When elastic cord 336 is released, its stored energy biases fastener 318 toward tree 316 due to engagement of cord 336 with collar plate 332, and engagement of the collar plate 332 with C-clip 334. Fastener 318 is thus rapidly accelerated or propelled toward the tree 316 so that tip portion 318*a* impacts and at least partially embeds into the tree. In this way, the sharpened and threaded tip portion 318*a* of fastener 318 can be easily initially driven into the tree 316 using only one hand, and without pounding using a hammer or other tool, or the user's hand. Fastener 318 may then be rotated to drive its threaded tip portion 318*a* further into the tree 316 until tree-climbing apparatus 310 is sufficiently secured to the tree. It will be appreciated that when fastener 318 is somewhat loosened so that collar plate 332 is not tightly pinched between fastener heat portion 318*b* and elongate body 312, collar plate 332 may be readily disengaged from fastener 318, which allows for full removal of the fastener 318 from apparatus 310 if desired (FIG. 21).

Thus, the tree climbing apparatus can be installed along a tree, wooden pole, or the like, in a one-handed manner, by initially setting the apparatus against the tree, and then using a single hand to draw a fastener rearwardly against the biasing force of a spring, elastic cord, or other biasing member, and then releasing the fastener so that it impacts the tree at high velocity to embed the fastener tip at least partially in the tree, followed by rotating the fastener to tightly secure the apparatus at the tree. Once the climbing apparatus is fully secured, the steps may be used as hand-holds and/or foot-holds as a climber scales a tree or other surface to which the climbing apparatus is attached. Standoffs may be provided to increase the space between the steps and the tree, and the standoffs and steps may be repositionable between use configurations and more compact storage or transport configurations. It will be appreciated that the climbing apparatus can be installed and removed by a user positioned at one side of a tree or pole, without need for the user to reach around or walk around the tree or pole during installation or removal. Optionally, a plurality of tree climbing apparatuses can be installed one above the other, to enable a climber to reach substantially any desired distance along the tree or pole.

Other tree-climbing apparatuses are envisioned that simplify installation, such as to further facilitate installation by a single user. Referring now to FIGS. 22-30D, another tree-climbing apparatus or assembly 410 is similar in many respects to apparatus 310, described above, but is configured for simplified installation at a tree or pole. Like tree-climbing apparatus 310, tree-climbing apparatus 410 includes an elongate body 412 with a plurality of steps or step portions 414*a-c* spaced vertically from one another and on alternating sides of the elongate body 412, the steps defining upper support surfaces for supporting a user's hand or foot. Tree-climbing apparatus 410 is attachable to a tree or pole 416 via a fastener 418 at the upper end portion of body 412, and via a lower mounting spike 424 at the lower end portion of body 412. A standoff 420 at fastener 418 maintains spacing between elongate body 412 and tree 416, and also stabilizes tree-climbing apparatus 410 and limits or prevents rotation of the apparatus as the fastener is being rotated. Standoff 420 includes a generally C-shaped tree-engaging portion 420*a*, a body-receiving bracket portion 420*b* having opposite tabs or projections that are positioned on either side of elongate body 412 when in the use position, and a hollow tubular horizontal extension 420*c*, which houses a spring or biasing element that urges standoff 420 against elongate body, in a substantially similar manner as standoff 320 with spring 328, described above.

Figure 27:
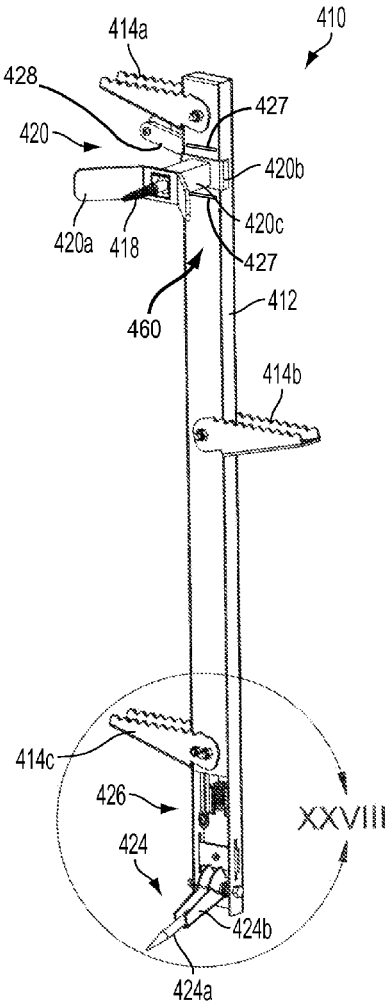
FIG. 27 is a rear perspective view of the climbing support of FIG. 22.

To facilitate storage, compactness, and portability when the apparatus is not in use, steps 414*a-c* are pivotably mounted to elongate body 412 via respective fasteners 422 (FIGS. 24, 26-28, 30A, and 30B), and are substantially similar to steps 314, as described above, such that their structure need not be repeated herein. Upper step 414*a* and middle step 414*b*, which are positioned at the upper and middle regions or portions of body 412, respectively, are substantially identical to the steps 314 of tree-climbing apparatus 310, while the lowermost step 414*c* is slightly modified to interact with a deployment mechanism 426 (FIGS. 25-28) that is associated with lower mounting spike 424, as will be described below. Standoff 420 is also rotatable by about 90-degrees to a storage configuration in which the opposite tabs or projections of bracket portion 420*b* are received in respective horizontal apertures or slots 427 formed in elongate body 412, located above and below standoff 420 (FIG. 27).

Figure 22:
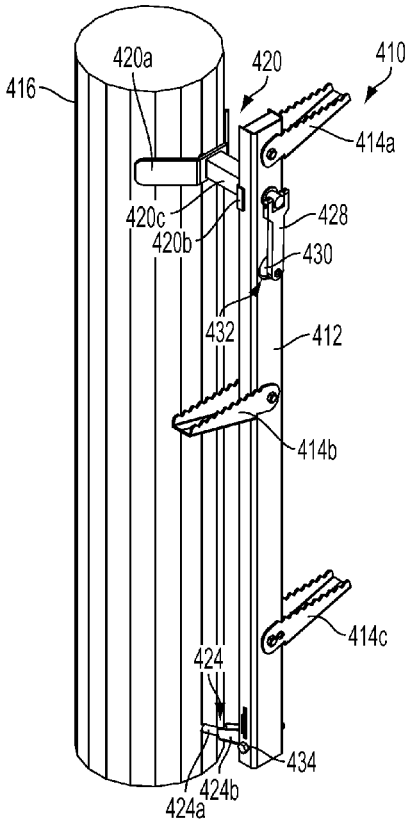
FIG. 22 is a perspective view of another climbing support in accordance with the present invention, which is shown positioned against the side of a tree or pole.
Figure 23:
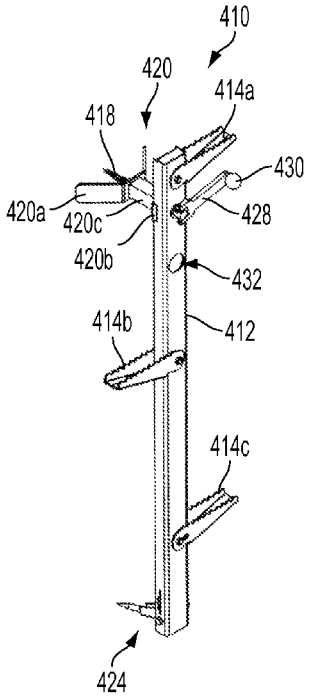
FIG. 23 is another perspective view of the climbing support of FIG. 22.
Figure 24:
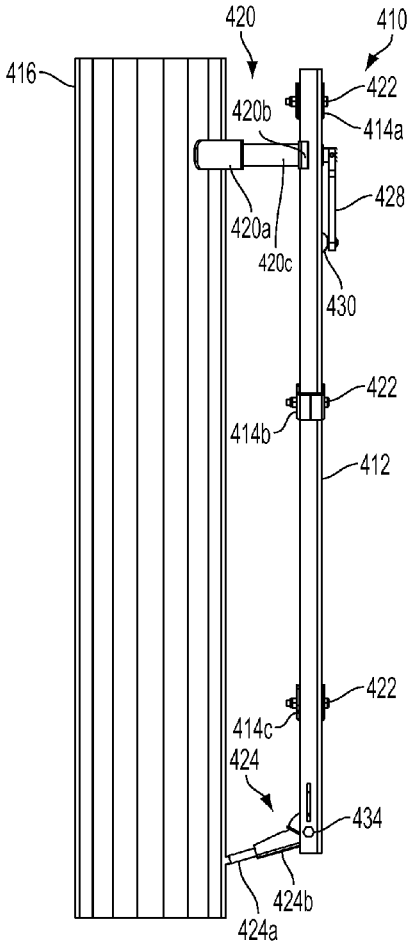
FIG. 24 is a side elevation of the climbing support and tree or pole of FIG. 22.
Figure 25:
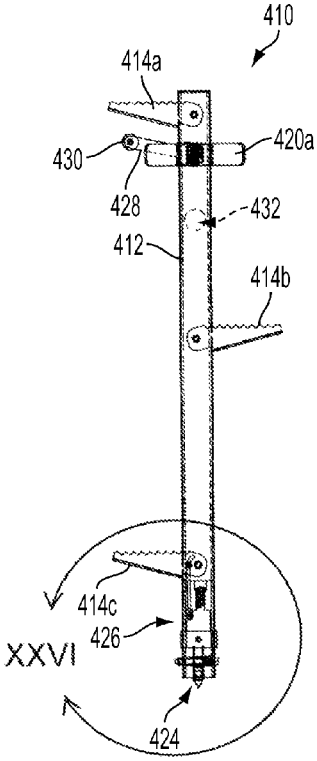
FIG. 25 is a rear elevation of the climbing support of FIG. 22.
Figure 26:
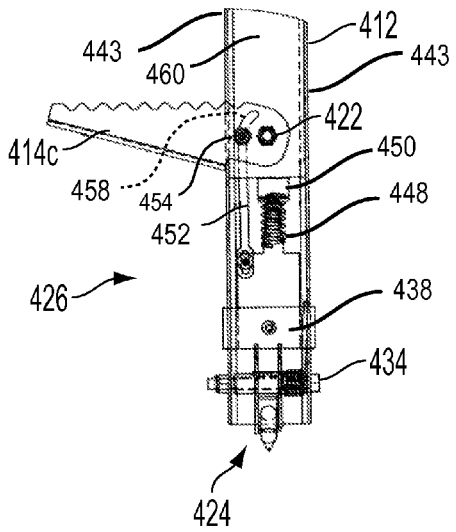
FIG. 26 is an enlarged rear elevation of a lower portion of the climbing support in the region designated XXVI in FIG. 25.

Tree-climbing apparatus 410 includes a crank arm 428 that is pivotably coupled to a proximal end portion of fastener 418, which protrudes from elongate body 412 (FIGS. 22-25, 27, and 30A-30D). Crank arm 428 includes a gripping portion 430 to facilitate grasping by a user, so that the crank arm 428 and fastener 418 can be turned together about the fastener's longitudinal axis to drive the fastener into the tree 416 (FIG. 30C), or to remove the fastener when detaching the apparatus. An opening 432 in elongate body 412 is sized to receive gripping portion 430 when crank arm 428 is pivoted about 180-degrees from its use position to its stowed position, such as shown in FIGS. 22 and 24.

Deployment mechanism 426 permits spike 424 to be secured in a fully-extended configuration in which the spike extends substantially straight out from the lower end portion of elongate body 412 (FIGS. 29 and 30), to an angled use position in which spike portion 424*a* can engage the tree 416 when elongate body 412 is aligned substantially parallel to the tree 416 to support at least some of a user's weight while keeping the lower end portion of the body 412 spaced from the tree (FIGS. 22, 24, 26, 28, 30B, and 30D), and to a collapsed or stowed position in which spike 424 is positioned substantially inside of elongate body 412. Spike 424 is pivotably coupled to elongate body 412 via a pivot bolt 434. A biasing element in the form of a coil torsion spring 436 is disposed around pivot bolt 434 to engage mounting portion 424*b* of spike 424 and bias the spike 424 away from the angled use position (or the collapsed or stowed position) and toward the straight extended configuration (i.e. in a counterclockwise direction as viewed in FIG. 29).

Figure 28:
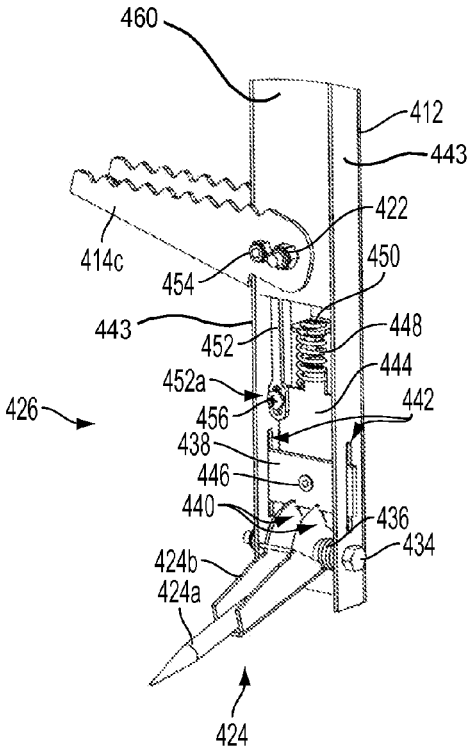
FIG. 28 is an enlarged rear perspective view of a lower portion of the climbing support in the region designated XXVIII in FIG. 27.
Figure 29:
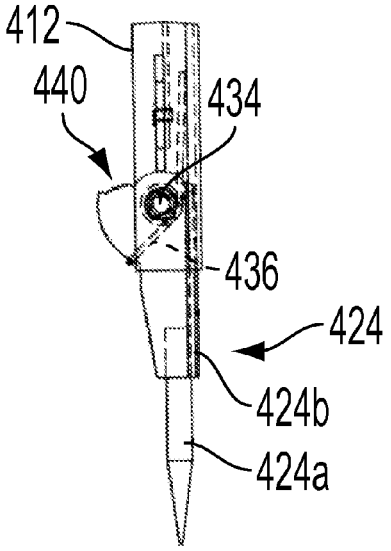
FIG. 29 is a side elevation of a lower portion of the climbing support of FIG. 22.

A lock plate 438 that spans the width of elongate body 412 engages ratchet tabs 440 to selectively prevent spike 424 from rotating or pivoting from the angled use position to the stowed position, as best shown in FIG. 28. Lock plate 438 includes opposite edge portions that are received in respective longitudinal slots 442 formed in sidewalls 443 of elongate body 412, which are of sufficient length to enable lock plate 438 to move a limited distance up and down relative to elongate body 412. Lock plate 438 is coupled to an actuation plate 444 via a fastener 446 (such as a rivet, bolt, weld, or the like), which in turn is actuated (moved) by an actuator link 452 controlled by lower step 414*c*, as will be described below.

Lock plate 438 is urged downwardly by a biasing element in the form of a coil spring 448 that is held in compression between a mounting tab 450, which is internal to elongate body 412. When lower step 414*c* is moved to its lowered or deployed position as shown in FIG. 28, step 414*c* also urges lock plate 438 downwardly, via a coupler rod 452, in the same direction as the biasing force of spring 448. Coupler rod 452 is pivotably coupled at its upper end portion to lower step 414*c* at a step actuator post 454, which is spaced radially outwardly from fastener 422. Coupler rod 452 further includes a lower mounting portion 452*a* that is coupled to actuation plate 444 via a fastener 456 to complete the coupling between lower step 414*c* and lock plate 438. In the illustrated embodiment, lower mounting portion 452*a* defines a slot or channel that receives fastener 456, which permits adjustment of the distance between lock plate 438 and actuator post 454 and/or permits actuation plate 444 to move along a small range of distance relative to actuator post 454 without moving lower step 414*c*. It will be appreciated that coil spring 448 also biases lower step 414*c* toward its deployed position (FIG. 28), by acting through actuation plate 444, coupler rod 452, and step actuator post 454.

Coupler rod 452 and lock plate 438 are moved up and down with the movement of lower step 414*c* between it stowed position (e.g., FIG. 30A) and its deployed position (e.g., FIG. 26), respectively. Step actuator post 454 is disposed in a curved slot 458 in a rear wall 460 of elongate body 412 (FIG. 26), which permits lower step 414*c* to pivot about its fastener 422. Actuator post 454 rotates with lower step 414*c* about fastener 422, and generally moves upwardly as lower step 414*c* is moved from its deployed position toward its stowed position, which draws lock plate 438 upwardly out of engagement with ratchet tabs 440 of the mounting portion 424*b* of spike 424.

Optionally, it is envisioned that coupler rod 452 could be replaced with a stiff but somewhat flexible actuator cable, rod, spring, or the like, which is sufficiently rigid to hold lock plate in engagement with ratchet tabs 440 when lower step 414*c* is deployed, but which is also sufficiently flexible that it will bend or buckle or compress under sufficient compressive load. For example, a user could grasp lock plate 438 (such as where its edge portions protrude through slots 442 in sidewalls 443 of elongate body 412) and lift the lock plate against the biasing force of spring 448 to buckle or bend the actuator cable (or other actuator element) that is used in place of coupler rod 452. This would allow a user to adjust the angle of spike 424 relative to elongate body 412 (at least slightly), even when the apparatus 410 is installed along a tree and lower step 414*c* is deployed.

Figure 30B:
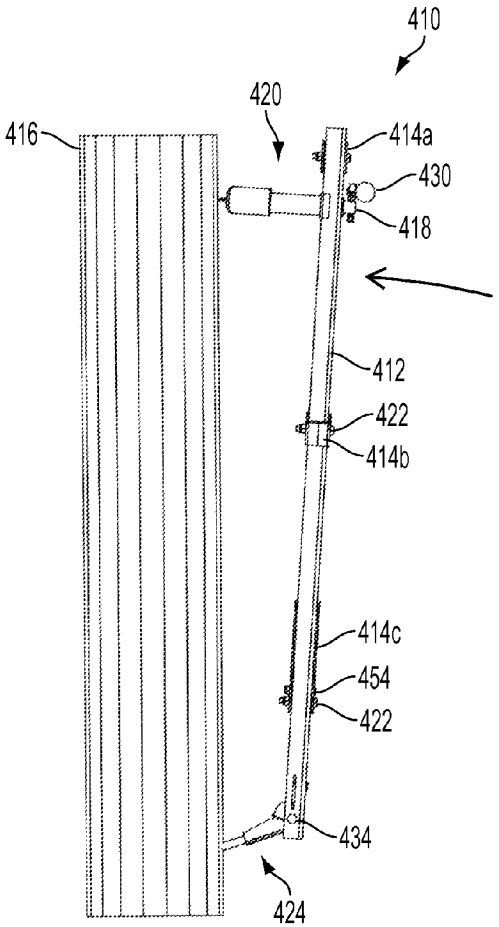
FIGS. 30A-30D are step-by-step sequential views depicting an installation method for the climbing support of FIG. 22.
Figure 30A:
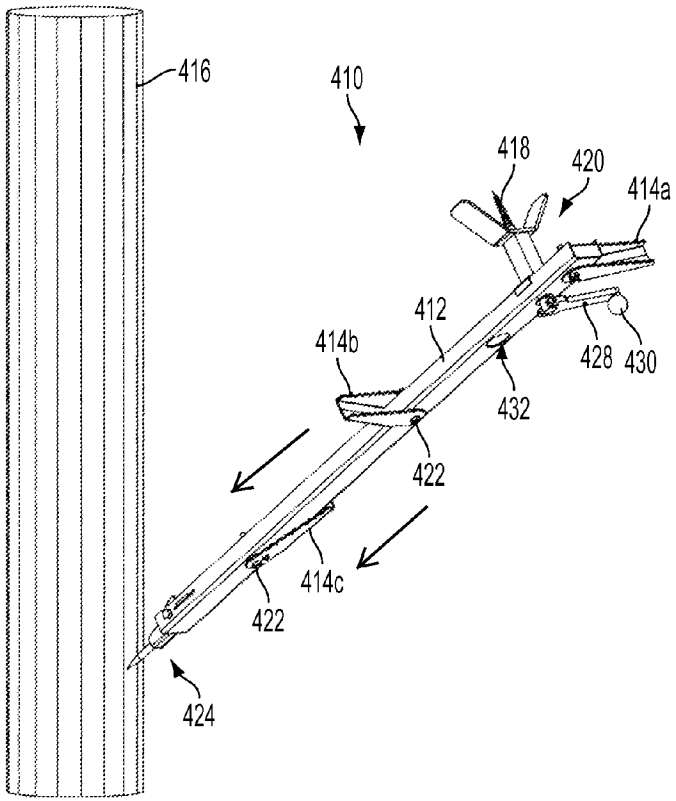
Figure 30C:
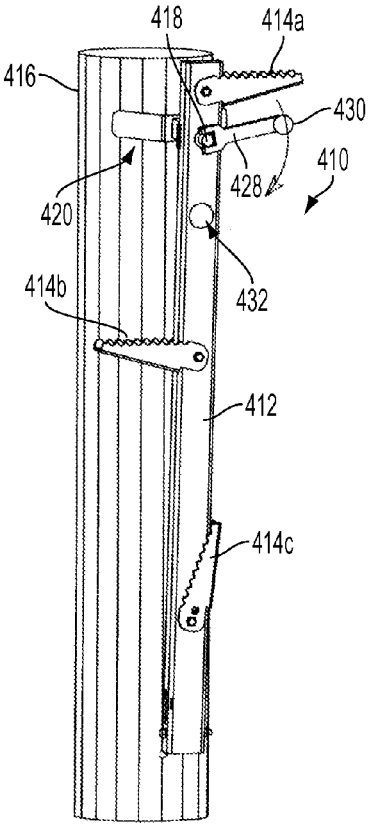

Accordingly, tree-climbing apparatus 410 may be readily and securely installed at the tree or pole 416 by a single user, in a relatively short period of time, and in just a few steps, such as shown in FIGS. 30A-30D. Tree-climbing apparatus 410 is initially configured for grasping the apparatus and thrusting it toward the tree 416 (as in the manner of a spear), with spike 424 in its straight configuration aligned with elongate body 412, so that spike portion 424*a* will be at least partially embedded into the tree (FIG. 30A). Standoff 420 is configured with a generally C-shaped tree-engaging portion 420*a* that is aligned for receiving a portion of the tree 416, and crank arm 428 is in its use position.

Once spike portion 424*a* is set into the tree 416, the upper portion of elongate body 412 is pushed toward the tree 416 by the user (FIG. 30B), which pivots elongate body 412 about pivot bolt 434 against the biasing force of torsion spring 436, which would otherwise bias spike 424 into alignment with elongate body 412 as shown in FIG. 30A. Fastener 418 engages tree 416 (FIG. 30B) and may be at least partially embedded therein as the user pushes the elongate body 412 toward the tree 416. For example, the user may push the upper portion of the elongate body 412 toward the tree 416 with sufficient speed and force that upon impact with the tree, at least the tip portion of the fastener 418, including a portion of the fastener threads, will be embedded through the bark layer and partly into the underlying wood (xylem). Optionally, the user may push the elongate body 412 toward the tree 416 more gently, and apply sufficient force to the elongate body 412 (and, thus, fastener 418) to enable the fastener 418 to bore into the tree upon rotation of crank arm 428.

Crank arm 428 is grasped by the user at the gripping portion 430 and is rotated to apply torque to fastener 418 until a bracket portion 420*b* of standoff 420 is drawn snugly against tree 416, which stabilizes tee-climbing apparatus 410 (and especially its upper portion) against side-to-side and vertical movement. Spike 424 remains imbedded in the tree 416 during tightening of the fastener 418, so that elongate body 412 typically pivots at least slightly relative to spike 424 as the upper portion of the elongate body 412 is drawn toward tree 416 by the fastener.

Figure 30D:
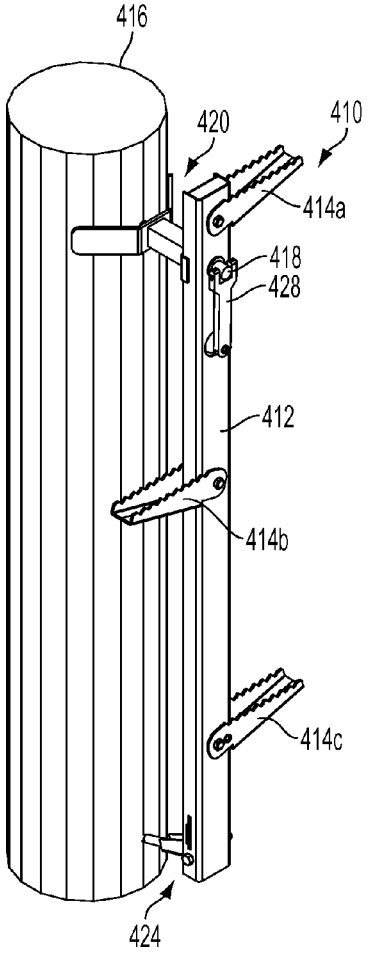

Once fastener 418 and the C-shaped tree-engaging portion 420*a* of standoff 420 are fully engaged, crank arm 428 may be positioned with gripping portion 430 at the top of its circular travel path so that crank arm 428 may be pivoted about 180-degrees downwardly with gripping portion 430 received in opening 432, such as shown in FIG. 30D. Upper step 414*a* and middle step 414*b* may be pivoted to their deployed positions if this has not already been done, and lower step 414*c* is pivoted to its deployed position, which urges lock plate 438 downwardly into contact with ratchet tabs 440 of the spike's mounting portion 424*b*. This contact prevents spike 424 from rotating further upwardly relative to elongate body 412, such as under loads applied by a person climbing and supporting their weight on steps 414*a-c*. Thus, with lower step 414*c* deployed, spike 424 is capable of supporting at least a portion of the weight of the tree-climbing apparatus 410 and a user positioned thereon, so that the loads are distributed between fastener 418, standoff 420, and spike 424.

Optionally, one or more tree-climbing apparatuses 410 may be installed in vertical arrangement to allow the user to climb higher into a tree than would otherwise be possible with a single tree-climbing apparatus. Once a first apparatus is fully installed at the tree 416 as described above, additional apparatuses may be installed by a user whose weight is supported on the first apparatus, although for safety and ease-of-use reasons, it may be desirable to for the user to secure themselves using a safety strap attached to the tree or the previously-installed climbing apparatus.

Tree-climbing apparatus 410 may be removed from tree 416 following the above-described steps in substantially the reverse order, by first pivoting the crank arm 428 to the use position and rotating it to remove the fastener 418 from tree 416. The elongate body 412 can be pivoted away from the tree regardless of whether or not lower step 414*c* has been raised to is stowed configuration, since the engagement of lock plate 438 with the ratchet tabs 440 of spike mounting portion 424*b* does not limit or prevent pivoting movement of spike 424 toward its straight configuration in-line with elongate body 412, such as shown in FIG. 30A. Once fastener 418 is disengaged from tree 416, a sufficiently strong tug or pull on elongate body 412 will dislodge spike portion 424*a* from tree 416 to fully disengage the tree-climbing apparatus 410 from the tree.

Once tree-climbing apparatus 410 has been removed from the tree 416, steps 414*a-c* are typically pivoted upwardly to their respective stowed positions to provide a narrower profile for the apparatus. In addition, standoff 420 may be drawn a sufficient distance from elongate body 412 to disengage its bracket portion 420*b* and permit rotation of the standoff 420 about 90-degrees to align its C-shaped tree-engaging portion 420*a* generally vertically and with the opposite ends of bracket portion 420*b* received in horizontal slots 427 of elongate body 412 and retained therein by the spring contained in horizontal extension 420*c*. In this way, the overall width of tree-climbing apparatus 410 is approximately equal to the width of elongate body 412. This reduces the space needed for long-term storage of the tee-climbing apparatus 410, as well as the space needed in a vehicle, such as the bed of a pickup truck or other vehicle, when transporting one or more tree-climbing apparatuses to a climbing site.

It will be appreciated that numerous design variations may be carried out without departing from the spirit and scope of the present invention. For example, the tee-climbing apparatus could be provided with two or more threaded fasteners with respective crank arms, either in place of or in addition to a spike that is set into the tree as described above. In addition, two or more standoffs may be provided to further add stability to the apparatus when installed along a tree or pole.

The tee-climbing apparatuses described above may be made primarily from steel, such as sheet steel that is cut and formed (e.g., bent, welded, etc) to the desired shapes, and optionally painted, powder-coated, or epoxy-coated as a final finish, which could optionally be a camouflage pattern, for example. However, it will be appreciated that numerous other sufficiently strong and corrosion-resistant materials may be suitable, such as high-strength aluminum alloy, or even certain high-strength composite materials or the like.

Thus, the tree climbing apparatus can be installed by a single user along a tree, wooden pole, or the like, in a one-handed manner, by initially thrusting a spike at the lower end of the apparatus into the tree, urging a fastener at the upper end of the apparatus into the tee and rotating the fastener to tightly secure the apparatus at the tree. Once the climbing apparatus is fully secured, the steps may be used as hand-holds and/or foot-holds as a climber scales a tree or other surface to which the climbing apparatus is attached. A standoff located at the fastener increases the space between the steps and the tree, and provides added stability to the device upon tightening the fastener to engage the standoff with the tree or pole. The standoff and the steps may be repositionable between use configurations and more compact storage or transport configurations.

Changes and modifications in the specifically-described embodiments can be carried out without departing from the principles of the present invention which is intended to be limited only by the scope of the appended claims, as interpreted according to the principles of patent law including the doctrine of equivalents.

The invention claimed is:

1. A climbing support apparatus for use in climbing a tree or pole, said climbing support apparatus comprising:

an elongate body having a tree-facing surface and an opposing surface spaced from said tree-facing surface and facing in a generally opposite direction as said tree-facing surface;

a step member extending outwardly from said elongate body;

a fastener movably coupled to said elongate body, said fastener having a tip portion projecting through an opening formed in said tree-facing surface and a head portion spaced from said tip portion, said head portion spaced outwardly from said opposing surface in the generally opposite direction, wherein said tip portion is drivable into the tree or pole and is securable at the tree or pole to thereby attach the climbing support apparatus to the tree or pole;

a biasing element arranged around said fastener and held in compression between said head portion and said opposing surface of said body, wherein said biasing element urges said tree-facing surface against the tree or pole when said tip portion of said fastener is driven at least partially into the outer portion of the tree or pole; and a spike at a lower end portion of said elongate body and configured for being driven at least partially into the tree or pole to stabilize said elongate body when said elongate body is mounted at the tree or pole.

2. The climbing support apparatus of claim 1, further comprising a standoff member coupled to said elongate body at said fastener and configured to engage the tree or pole and to maintain a space between said elongate body and the tree or pole when said fastener is secured.

3. A climbing support for use in climbing a tree or pole, said climbing support comprising:

a body having an upper support surface, a tree-facing surface, and an outwardly-facing surface spaced from said tree-facing surface and facing in a generally opposite direction as said tree-facing surface, said tree-facing surface defining a first bore and said outwardly-facing surface defining a second bore;

a fastener movably disposed in said first and second bores, said fastener having a tip portion and a head portion spaced from said tip portion, said head portion spaced outwardly from said outwardly-facing surface and configured to facilitate rotation of said fastener, wherein said fastener is supported at said body in a manner such that at least part of said tip portion projects from said tree-facing surface of said body when a force is applied to said fastener in the direction of said tree-facing surface;

a biasing element positioned between said head portion and said outwardly-facing surface, wherein said biasing element urges said tree-facing surface against the tree or pole when said tip portion of said fastener is driven at least partially into the outer portion of the tree or pole;

a projection at said tree-facing surface and spaced from said fastener, said projection configured to engage the tree or pole when said climbing support is mounted thereat; and wherein said body is configured to be engaged by a user's hand or a tool, and said tip portion of said fastener and said projection are configured to be driven against the outer portion of the tree or pole, whereby at least one of said tip portion of said fastener and said projection initially support said body at the tree or pole, and said projection limits rotation of said body relative to the tree or pole as the user rotates said fastener to drive said tip portion further into the tree or pole to secure said body at the tree or pole.

4. The climbing support of claim 3, wherein said fastener comprises a lateral projection that is spaced between said tip portion and said head portion, and that is configured to selectively engage said body to limit longitudinal movement of said fastener in said bore when said fastener is moved a predetermined distance, whereby said at least part of said tip portion of said fastener is prevented from retracting fully into said bore.

5. The climbing support of claim 3, wherein said body defines an opening below said upper support surface, said opening configured as at least one of (i) a hand-hold, (ii) a foot support, and (iii) a tool support.

6. The climbing support of claim 5, wherein said opening is configured as a tool support.

7. The climbing support of claim 6, further in combination with a tool having a handle portion and a fastener-engaging portion, wherein said opening of said body is configured to releasably couple to said fastener-engaging portion of said tool so that said tool can be grasped at said handle portion and used to drive the climbing support against the tree or pole, and wherein said fastener-engaging portion is configured to receive said head portion of said fastener to rotatably drive said fastener.

8. The climbing support of claim 3, wherein said tip portion of said fastener is at least partially threaded.

9. The climbing support of claim 3, wherein said biasing element is disposed around said fastener and is held in compression between said head portion and said outwardly-facing surface.

10. The climbing support of claim 9, wherein said biasing element comprises a coil spring having an inboard end disposed against said outwardly-facing surface and an outboard end disposed against said head portion of said fastener.

11. The climbing support of claim 3, wherein said head portion of said fastener comprises a non-circular head portion for engagement by a tool.

12. The climbing support of claim 3, further in combination with a support rack, wherein said opening of said body is configured to receive a portion of said support rack so that a plurality of said climbing supports are supportable at said support rack for storage of said climbing supports.

13. The climbing support of claim 3, wherein said projection comprises a spike having a sharpened tip.

14. The climbing support of claim 3, wherein said body comprises an elongate member defining said tree-facing surface and at least one step portion that extends substantially perpendicularly outwardly from said elongate member and defines said upper support surface.

15. A climbing support for use in climbing a tree or pole, said climbing support comprising:

a body having an upper support surface, a tree-facing surface, and an outwardly-facing surface spaced from said tree-facing surface and facing in a generally opposite direction as said tree-facing surface, said tree-facing surface having an upper end portion proximate said upper support surface and a lower end portion opposite said upper end portion, wherein said tree-facing surface and said outwardly-facing surface define respective openings, and said body defining an opening below said upper support surface;

a fastener disposed in said openings, said fastener having an at least partially threaded tip portion projecting from said upper end portion of said tree-facing surface, and said fastener having a head portion spaced from said tip portion, said head portion spaced outwardly from said outwardly-facing surface and configured to facilitate rotation of said fastener; and a biasing element positioned between said head portion and said outwardly-facing surface, wherein said biasing element urges said tree-facing surface against the tree or pole when said tip portion of said fastener is driven at least partially into the outer portion of the tree or pole;

wherein said opening in said body is configured to be engaged by a user's hand or a tool, and said at least partially threaded tip portion of said fastener is configured to be manually driven into the outer portion of the tree or pole, whereby said at least partially threaded tip portion of said fastener initially supports said body at the tree or pole; and wherein said upper end portion of said tree-facing surface comprises an upper end that projects forwardly of the remainder of said upper end portion of said tree-facing surface, and that projects forwardly of said lower end portion of said tree-facing surface when said tree-facing surface is oriented vertically.

16. The climbing support of claim 15, further comprising a spike projecting from said body at said lower end portion of said tree-facing surface, wherein said spike is configured to initially support said body at the tree or pole, and said spike substantially prevents rotation of said body relative to the tree or pole as the user rotates said fastener to drive said at least partially threaded tip portion further into the tree or pole to secure said body at the tree or pole.

17. The climbing support of claim 16, wherein said upper end of said upper end portion of said tree-facing surface contacts the tree or pole and acts as a fulcrum as the user rotates said fastener to drive said spike into the tree or pole substantially simultaneously with said at least partially threaded tip portion of said fastener.

* * * * *